US007707667B1

(12) United States Patent
Walton

(10) Patent No.: US 7,707,667 B1
(45) **Date of Patent: *May 4, 2010**

(54) PADDED BACKBOARD COVERSLIP

(76) Inventor: Ross T. Walton, 151 Windsor Ave., Bardstown, KY (US) 40004

( * ) Notice: Subject to any disclaimer, the term of this patent is extended or adjusted under 35 U.S.C. 154(b) by 0 days.

This patent is subject to a terminal disclaimer.

(21) Appl. No.: 12/425,618

(22) Filed: Apr. 17, 2009

Related U.S. Application Data

(63) Continuation-in-part of application No. 11/511,247, filed on Aug. 29, 2006, now abandoned, which is a continuation-in-part of application No. 11/108,082, filed on Apr. 15, 2005, now Pat. No. 7,100,226.

(51) Int. Cl.
*A61G 1/04* (2006.01)
*A61G 1/00* (2006.01)

(52) U.S. Cl. ..... 5/626; 5/625; 5/691; 128/870

(58) Field of Classification Search ..... 5/625–629, 5/499, 691, 636, 484; 128/869, 870
See application file for complete search history.

(56) References Cited

U.S. PATENT DOCUMENTS

| | | | |
|---|---|---|---|
| 30,588 | A | 11/1860 | Pitts |
| 2,517,443 | A | 8/1950 | Rhodes |
| 4,167,151 | A | 9/1979 | Muraoka et al. |
| 4,439,473 | A | 3/1984 | Lippman |
| 4,536,454 | A | 8/1985 | Haasl |
| 4,680,204 | A | 7/1987 | Das et al. |
| 4,983,424 | A | 1/1991 | Saidman et al. |
| 5,088,137 | A | 2/1992 | Rose |
| 5,118,557 | A | 6/1992 | Barnewall |
| 5,256,716 | A | 10/1993 | Haasl et al. |
| 5,314,940 | A | 5/1994 | Stone |
| 5,424,828 | A | 6/1995 | Minami |
| 5,429,840 | A | 7/1995 | Raterman et al. |
| 5,481,770 | A | 1/1996 | Ahlsten |
| 5,819,746 | A | 10/1998 | Walton |
| 6,067,678 | A | 5/2000 | Trevino |
| 6,138,306 | A | 10/2000 | Muhanna |
| 6,228,476 | B1 | 5/2001 | Bogrett et al. |
| 6,315,938 | B1 | 11/2001 | Jandali |
| 6,420,471 | B1 | 7/2002 | Douarre |
| 6,634,042 | B2 | 10/2003 | Blossman |
| 6,848,134 | B1 | 2/2005 | Schenck |
| 7,100,226 | B1 | 9/2006 | Walton |
| 2003/0121103 | A1 | 7/2003 | Wempe |
| 2005/0255307 | A1 | 11/2005 | Dennis et al. |
| 2006/0032572 | A1 | 2/2006 | Dennis et al. |

*Primary Examiner*—Alexander Grosz
(74) *Attorney, Agent, or Firm*—Donald K Wedding

(57) ABSTRACT

A backboard pad assembly comprising a body pad and cranial pad with side wrappings and a back coverslip attached to the body pad. The side wrappings and back coverslip may be of one piece are typically of an elastic material and extend around an associated backboard so as to retain the body pad to the backboard. The body pad has a width that is less than the distance between side handholds of an associated backboard such that the handholds are not covered by the body pad and have a length such that any end handholds of the associated backboard are not covered by the body pad. The body pad follows the profile of the associated backboard. The body pad, cranial pad, side wrappings, and back coverslip are made of or are covered with a coating of material that is waterproof and chemically resistant and capable of being medically disinfected.

19 Claims, 25 Drawing Sheets

PADDED BACKBOARD COVERSLIP

RELATED APPLICATIONS

This application is a continuation-in-part under 35 U.S.C. 120 of U.S. patent application Ser. No. 11/511,247 filed Aug. 29, 2006, now abandoned, which is a continuation-in-part under 35 U.S.C. 120 of U.S. patent application Ser. No. 11/108,082 filed Apr. 15, 2005, now U.S. Pat. No. 7,100,226 issued Sep. 5, 2006.

FIELD OF THE INVENTION

This invention has its use in the immobilization of trauma victims, particularly those with potential spinal injuries.

BACKGROUND OF INVENTION

Presently either wooden or synthetic backboard devices or backboards transport victims or patients of trauma from the scene of injury to a hospital. Often these patients must remain secured to the backboard device for several hours. Multiple studies have demonstrated that these backboard devices are extremely uncomfortable and can cause decubitus ulcer formation in certain high-risk individuals such as those paralyzed as a result of their injuries. Furthermore, placing patients flat on these backboards result in the patient's neck resting in an anatomically hyperextended position. A study from 1993 demonstrated that the addition of padding to these backboards improves patient comfort and may decrease the likelihood of decubitus ulcer formation without compromising spinal immobilization. Other research has shown that additional cranial or head padding to elevate and/or support the head, places the spine in an anatomically neutral position and may therefore decrease the risk of cervical spine injury.

Conventional backboard pads or pads have numerous shortcomings. Many are of excessive width that prevents or hinders the transporter from placing his or her hand inside the handholds on the sides of the underlying backboard. Some backboard pads secure to backboards with straps that cross beneath the backboard, preventing the transporter from sliding the backboard when necessary. Some backboard pads are incorporated into the construction of the underlying backboard. These function well but are prohibitively expensive to many ambulance companies whose patients could benefit from a pad that adapts to the backboards already in use.

SUMMARY OF THE INVENTION

This invention relates to a backboard pad assembly comprising a pad and side wrappings and back coverslip that emanate from the sides of the pad so as to extend around the backboard and retain the pad to the backboard. The pad comprises a body pad and a cranial pad for support of the head. The cranial pad may be attached to or integrated as part of the body pad. The pad is composed of foam or other pliable material for support and cushioning of the body and head. The pad is made from or coated with a waterproof and chemically resistant material that can be medically disinfected for multiple use. The side wrappings and back coverslip are attached to the pad and are preferably of an elastic material that wraps around and secures the pad to the backboard. The side wrappings and back coverslip are preferably one continuous piece. The side wrappings and back coverslip are made from or coated with a waterproof and chemically resistant material that can be medically disinfected for multiple use. The pad including the body pad and cranial pad, the side wrappings and back coverslip can be made of or coated with the same waterproof and chemically resistant material that can be medically disinfected.

The dimensions of the pad are sufficiently narrow so as to allow the handholds in a backboard to be exposed. Optionally, the pad is equal in width to the backboard with recessed areas in the pad to expose the handholds of the backboard. The pad may be shaped, when viewed from above, so as to follow the contour or geometric profile of the associated backboard.

The side wrappings and back coverslip fit around and grip the backboard so as to envelop it. The side wrappings may extend from beneath the cranial pad. The backboard pad assembly is placed on the backboard by sliding it onto one end of the backboard. Optionally, the side wrappings may extend around the backboard and attach to itself with a hook-and-loop closure such as VELCRO®, or some other similar method. VELCRO® is a registered trademark of Velcro Industries B.V. The side wrappings are composed of an elastic material or the like.

Openings in the pad and/or the side wrappings correspond in location to the handholds in the backboard. The pad, including the body pad and cranial pad, side wrappings, and/or back coverslip may be offered in a variety of shapes, sizes, and overall profiles to accommodate different shapes and sizes of backboards, including pediatric backboards.

The cranial pad and body pad may be made of the same or different materials. Typical materials include rubber, plastic, or polymeric materials that support and cushion the patient. Polymeric foam materials include polyurethane, polyester polyurethane, polyolefins, polystyrene, polyethylene, and cross-linked polyethylene. The foam may be flexible or semi-flexible and may be open cell or closed cell.

The pads, side wrappings, and back coverslip are made from or coated with a waterproof and chemically resistant material that can be medically disinfected such that they can be reused. Both organic and inorganic coatings are contemplated. Examples of materials that can be used to coat the pads, especially foam pads, include acrylics, polyacrylates such as the methacrylates, epoxies, thermoplastic rubber, vinyl materials such as polyvinyl chloride and so forth. The coating may contain particles of inorganic materials including pigments and fillers such as carbon, zinc oxide, titanium oxide, and so forth. These may also be used to coat the side wrappings and back coverslip.

Examples of coating compositions and methods for applying a coating or film to a foam or other base including the side wrappings and back coverslip are disclosed in U.S. Pat. Nos. 4,167,151 (Muraoka et al.), 4,439,473 (Lippman), 4,536,454 (Haasl), 4,680,204 (Das et al.), 4,983,424 (Saidman et al.), 5,118,557 (Barnewall), 5,256,716 (Haasl et al.), 5,314,940 (Stone), 5,424,828 (Minami), 5,429,840 (Raterman et al.), 6,228,476 (Borgrett, et al.), 6,315,938 (Jandali), 6,420,471 (Douarre), and U.S. Patent Publication Nos. 2003/0121103 (Wempe), 2005/0255307 (Dennis et al.), and 2006/0032572 (Dennis et al.), all incorporated herein by reference.

BRIEF DESCRIPTION OF THE DRAWINGS

The above features and advantages of this invention are illustrated in the following drawings where.

DETAILED DESCRIPTION OF THE DRAWINGS

FIGS. 1, 2, 3, and 4 depict the backboard pad assembly 101 secured to a backboard 102.

Figure 1:
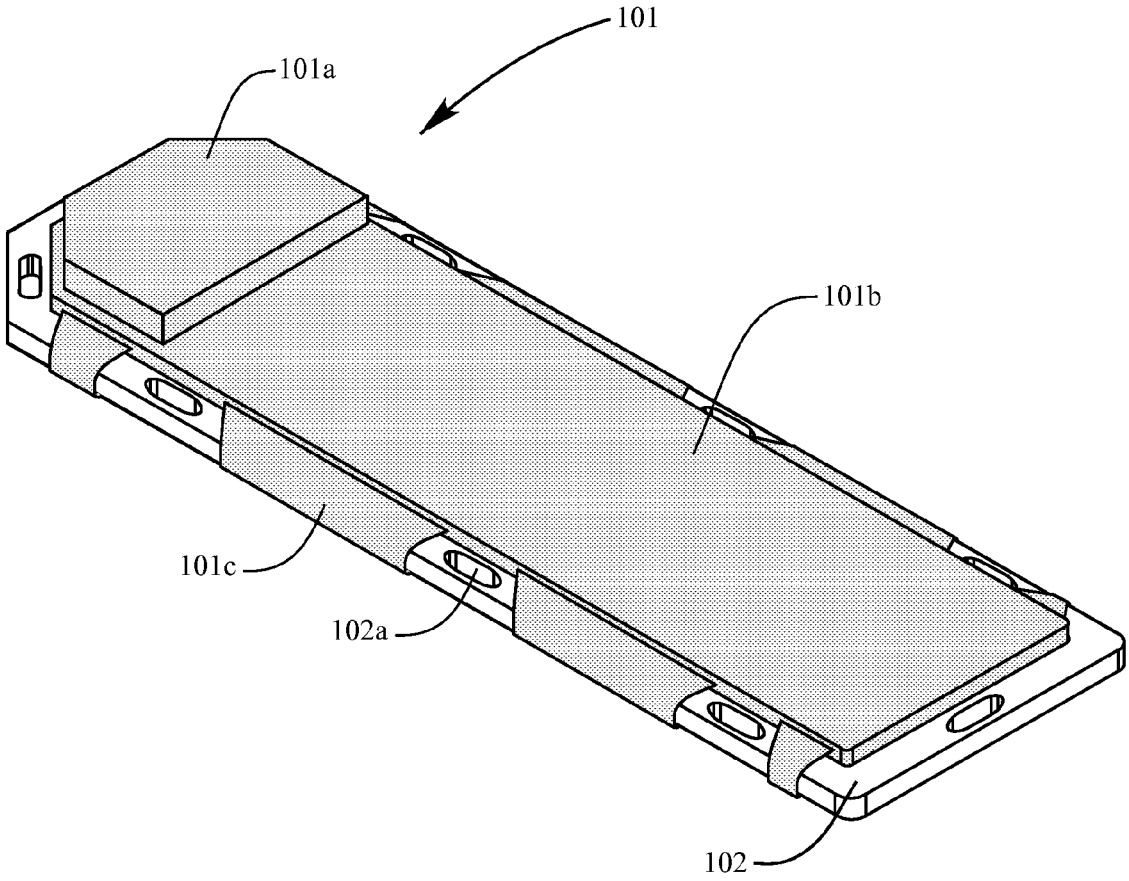
FIG. 1 is an orthogonal view of one embodiment of a backboard pad assembly mounted on a backboard.

FIG. 1 is an orthogonal view of one embodiment of a backboard pad assembly 101 mounted on a backboard 102 with handholds 102*a*. Shown are cranial pad 101*a*, body pad 101*b*, and side wrappings 101*c*. The bottom wrapping or back coverslip 101*g* (not visible in this view) and side wrappings 101*c* are typically constructed from one continuous piece of material that may be elastic.

This invention improves patient care with respect to trauma patients particularly those with potential spinal cord injuries. As shown in FIG. 1, the cranial pad 101*a* and body pad 101*b* have edges within the inner limits of the handholds 102*a* of the backboard 102.

The cranial pad 101*a*, when viewed from the top, tapers so as to follow the contour of a backboard 102 with similar tapering. Hence, the backboard pad assembly 101 will not encroach upon the handholds 102*a* of the backboard 102.

Figure 1A:
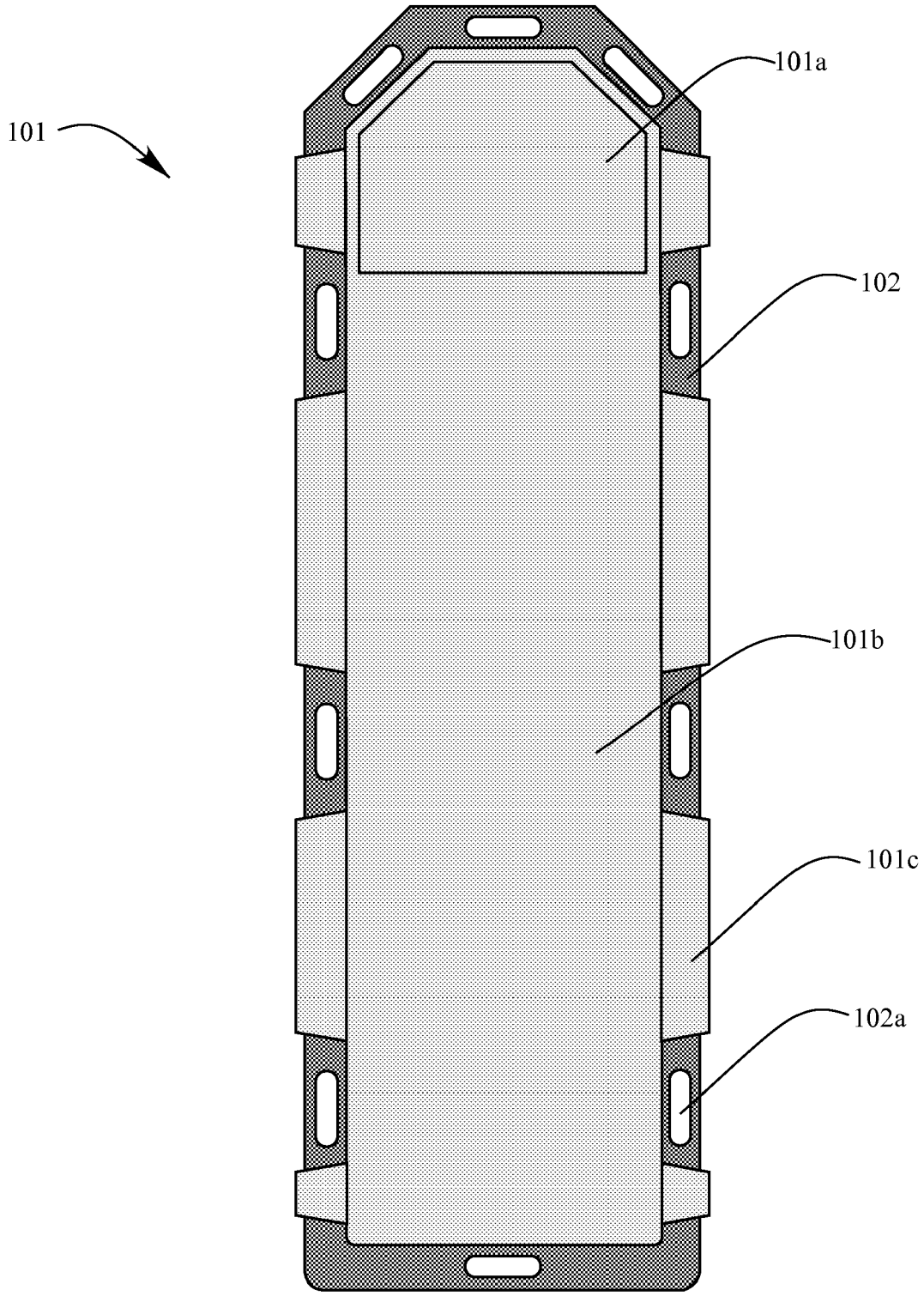
FIG. 1A is a top view of the backboard pad assembly shown in FIG. 1.

FIG. 1A is a top view of the embodiment of FIG. 1. Shown are cranial pad 101*a*, backboard 102, body pad 101*b*, side wrappings 101*c*, and backboard handholds 102*a*. The backboard 102 is enclosed by the backboard pad assembly 101.

Figure 1B:
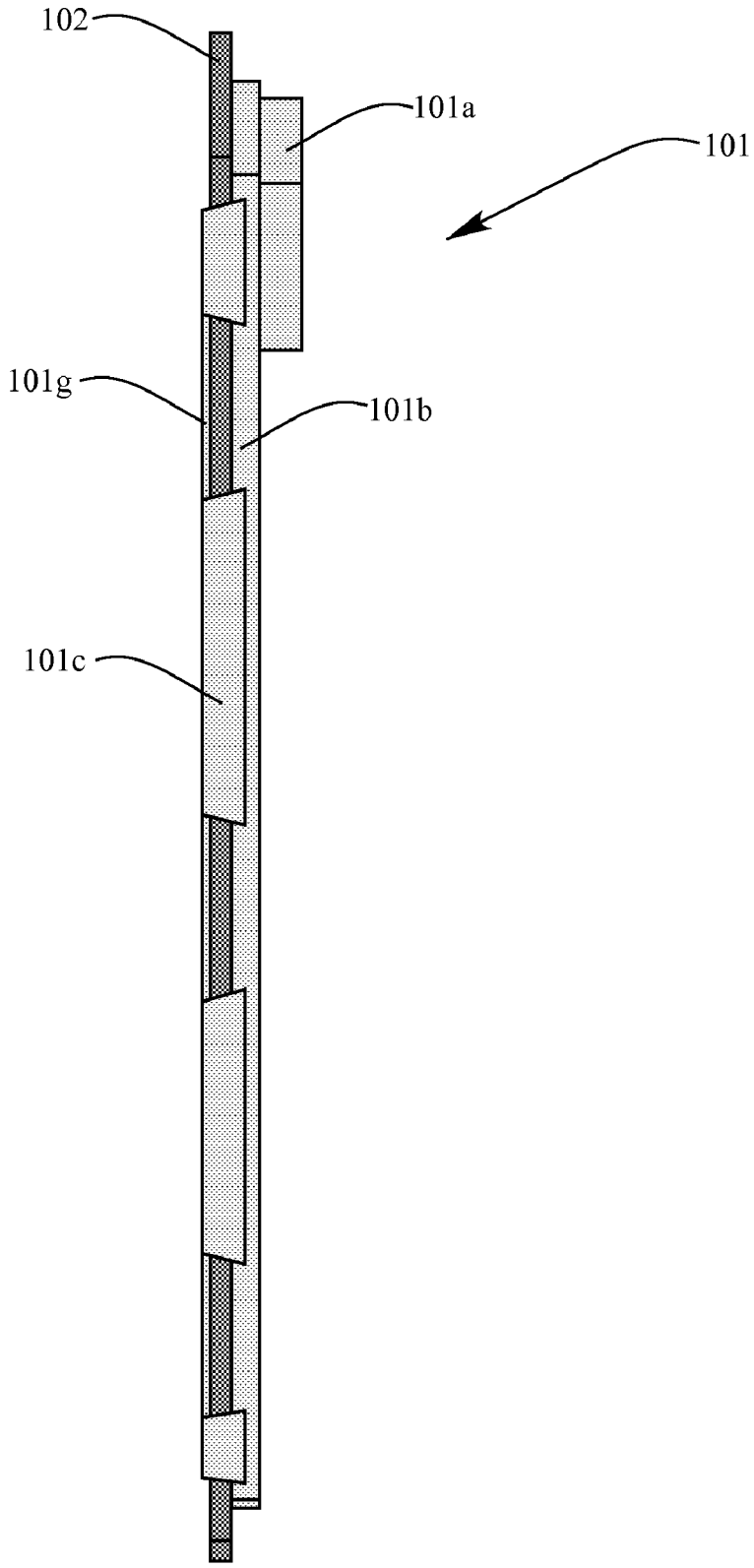
FIG. 1B is a left side view of the backboard pad assembly shown in FIG. 1. The right side view is a mirror image of FIG. 1B.

FIG. 1B is a left side view of the backboard pad assembly 101 shown in FIG. 1. The right side view is a mirror image of FIG. 1B. Also shown are backboard 102, cranial pad 101*a*, body pad 101*b*, bottom wrapping 101*g*, and side wrappings 101*c*. The cranial pad 101*a* is elevated relative to the body pad 101*b* in order to place the spine in an anatomically neutral position. The cranial pad 101*a* and body pad 101*b* may be made from one piece of material.

FIGS. 1 and 1B show the difference in thickness or height between the cranial pad 101*a* and the body pad 101*b*. The cranial pad 101*a* elevates the patient's head, thus maintaining the cervical spine in an anatomically neutral position.

Figure 1C:
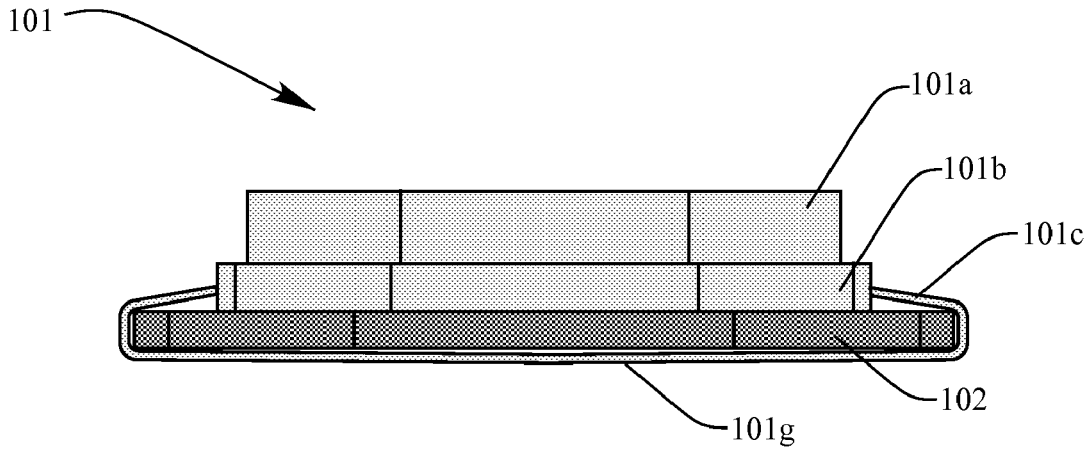
FIG. 1C is a headward end view of the backboard pad assembly shown in FIG. 1.

FIG. 1C is a headward end view of the backboard pad assembly 101 shown in FIG. 1. Shown are backboard 102, cranial pad 101*a*, body pad 101*b*, bottom wrapping 101*g*, and side wrappings 101*c*.

Figure 1D:
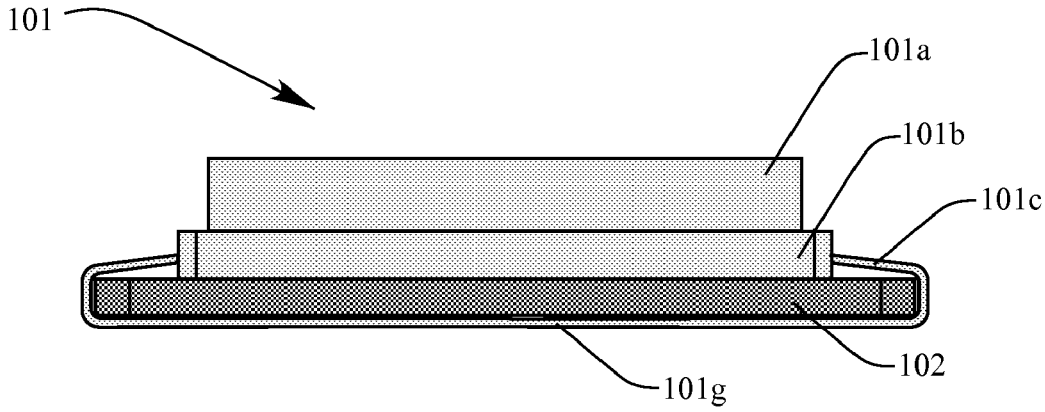
FIG. 1D is a footward end view of the backboard pad assembly shown in FIG. 1.
Figure 1E:
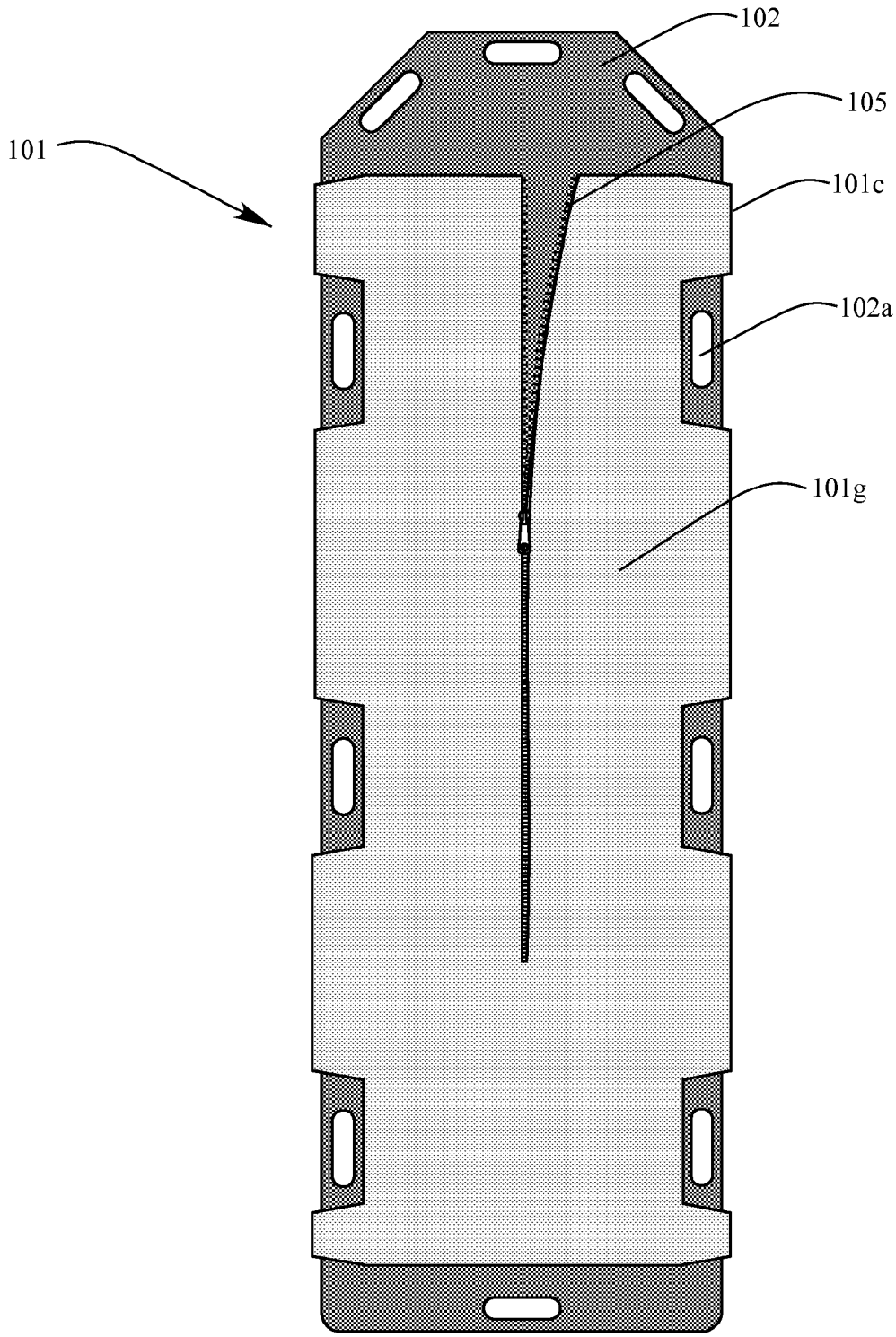
FIG. 1E is a bottom view of one embodiment of the backboard pad assembly shown in FIG. 1.

FIG. 1D is a footward end view of the backboard pad assembly 101 shown in FIG. 1. Shown are backboard 102, cranial pad 101*a*, body pad 101*b*, bottom wrapping or coverslip 101*g*, and side wrappings 101*c*.

Figure 1F:
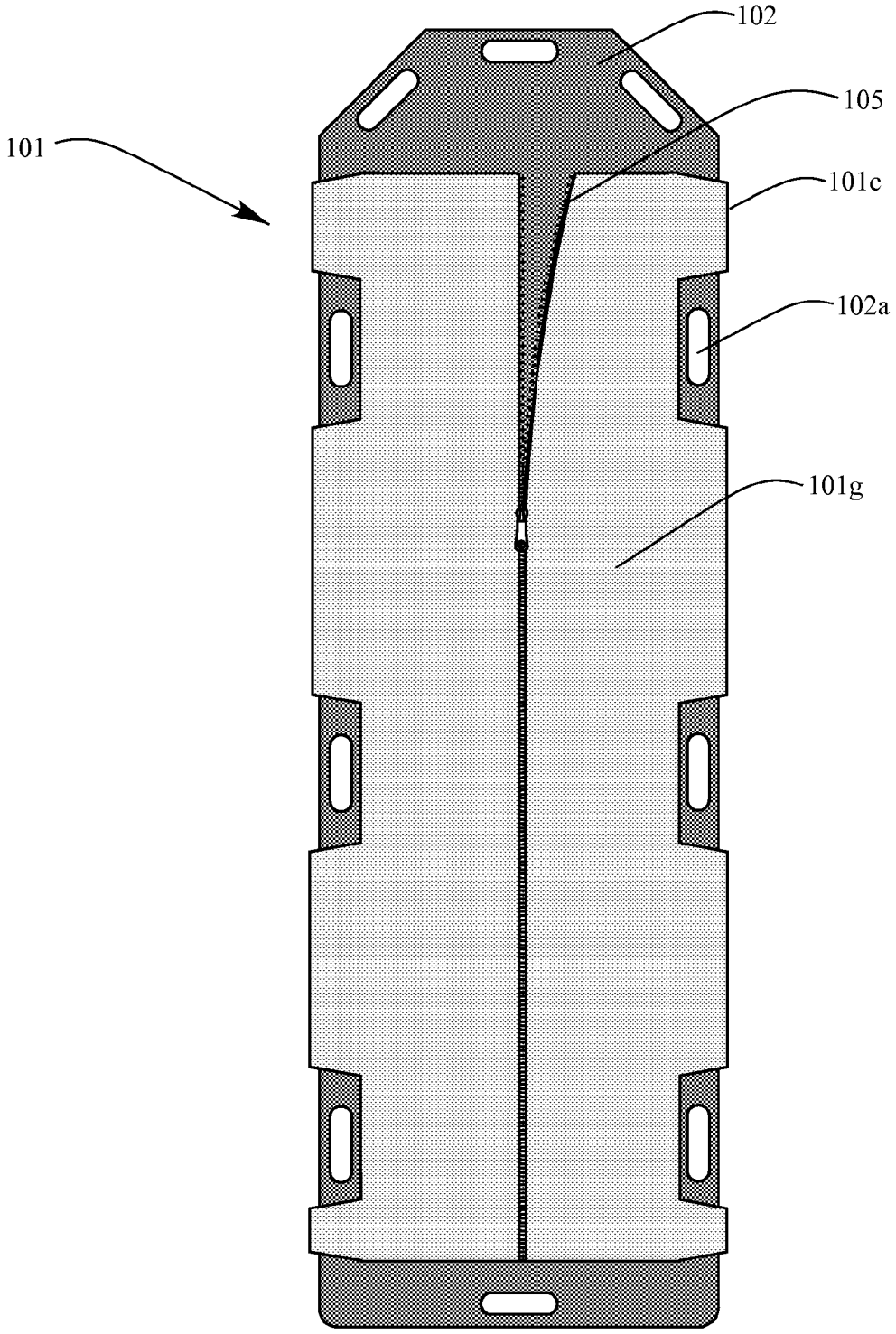
FIG. 1F is a bottom view of another embodiment of the backboard pad assembly shown in FIG. 1.

FIG. 1F is a bottom view of one embodiment of the backboard pad assembly 101 shown in FIG. 1. Shown are backboard 102, zipper 105, backboard handholds 102*a*, bottom wrapping 101*g*, and side wrappings 101*c*. The bottom wrapping 101*g* has an integrated zipper 105, which runs lengthwise down the center of the bottom wrapping 101*g*. The function of the zipper 105 is to relax the bottom wrapping 101*g* and facilitate the attachment and removal of the backboard pad assembly 101 to the backboard 102. Because the zipper 105 does not run the entire length of the bottom wrapping 101*g*, there is no need for the operator to engage the zipper 105 each time the backboard pad assembly 101 is replaced. In another embodiment, the zipper 105 may extend the entire length of the bottom wrapping 101*g*. In other embodiments, other fastening means may be utilized such as a strip of VELCRO®, snaps, hooks, or the like to perform the zipper's function.

FIG. 1F is a bottom view of another embodiment of the backboard pad assembly 101 shown in FIG. 1. Shown are backboard 102, zipper 105, backboard handholds 102*a*, bottom wrapping 101*g*, and side wrappings 101*c*. The bottom wrapping 101*g* has an integrated zipper 105, which runs lengthwise down the center of the bottom wrapping 101*g*. The function of the zipper 105 is to relax the bottom wrapping 101*g* and facilitate the attachment and removal of the backboard pad assembly 101 to the backboard 102. In this embodiment, the zipper 105 extends the entire length of the bottom wrapping 101*g*. In other embodiments, other fastening means may be utilized such as a strip of VELCRO®, snaps, hooks, or the like to perform the zipper's function.

Figure 2A:
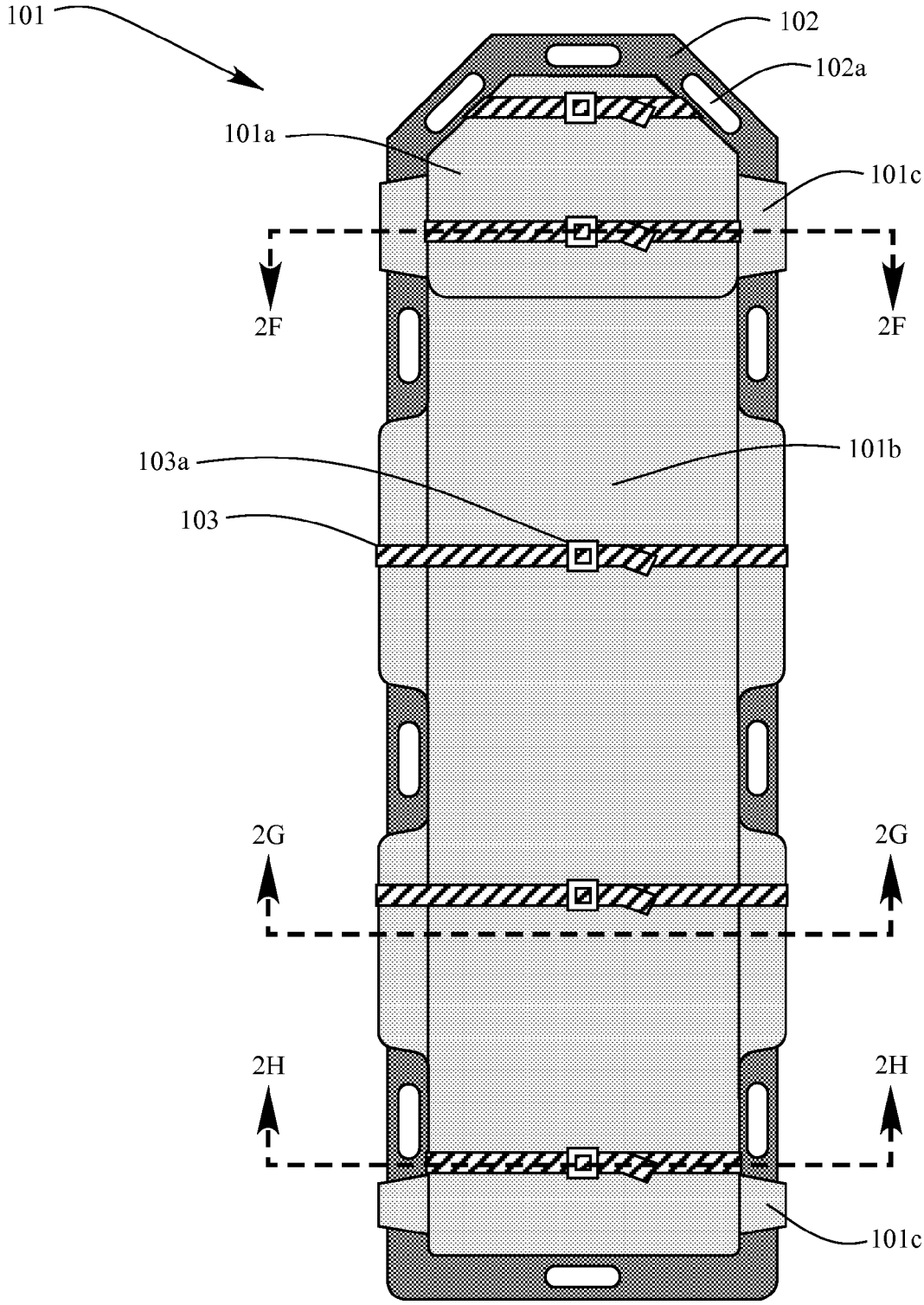
FIG. 2A is a top view of another embodiment of the backboard pad assembly.

FIG. 2A is a top view of another embodiment of the backboard pad assembly 101. FIG. 2A alternately demonstrates the cranial pad 101*a* extending to the edges of the body pad 101*b*. Here the body pad 101*b* has recesses to allow for clearance of the backboard handholds 102*a*. The side wrappings 101*c* extend around the backboard 102. Tension from the elastic nature of the side wrappings 101*c* keeps the backboard pad assembly 101 securely attached to the backboard 102.

The cranial pad 101*a*, when viewed from the top, tapers so as to follow the contour of a backboard with similar tapering. Hence, the cranial pad 101*a* and the footward end of the body pad 101*b* will not encroach upon the handholds 102*a* of the backboard 102.

Alternatively, the edges of the cranial pad 101*a* and body pad 101*b* may extend to the edges of the backboard 102, but the edges of the pad will be recessed to the inner limits of the handholds 102*a* present on the backboard 102 as shown in FIG. 2A.

Also depicted are immobilization straps or restraints 103 which are fastened together by a buckle 103*a*. The immobilization straps 103 and buckles 103*a* serve to secure the patient to the backboard 102. Other means of fastening the immobilization straps such as VELCRO® may alternatively be used. The cranial pad 101*a* elevates the patient's head and maintains the cervical spine in an anatomically neutral position.

Figure 2B:
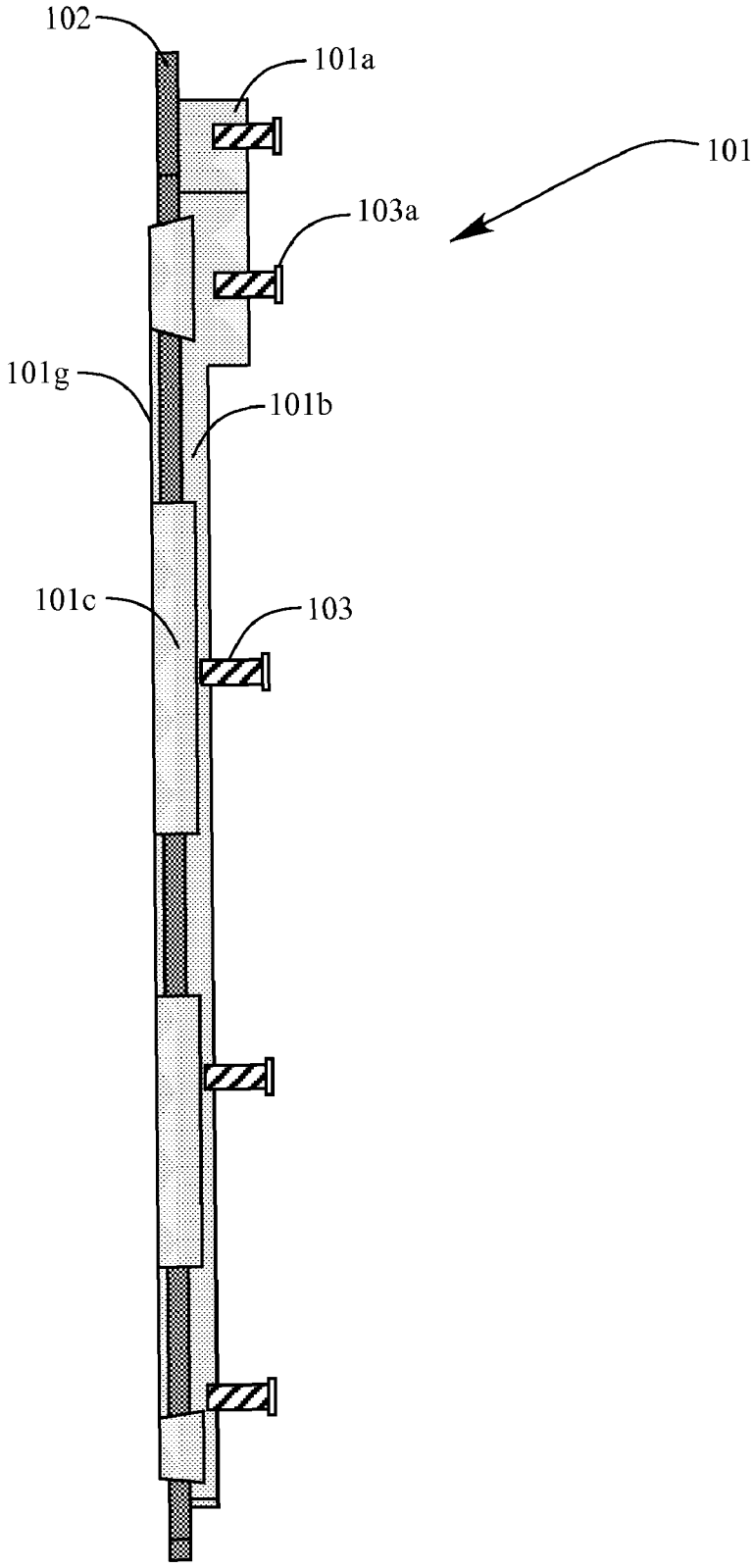
FIG. 2B is a left side view of the backboard pad assembly shown in FIG. 2A. The right side view is a mirror image of FIG. 2B.

FIG. 2B is a left side view of the backboard pad assembly 101 shown in FIG. 2A. The right side view is a mirror image of FIG. 2B. Also shown are backboard 102, cranial pad 101*a*, restraint buckle 103*a*, body pad 101*b*, side wrappings 101*c*, bottom wrapping 101*g*, restraints 103, and restraint buckle 103*a*. The cranial pad 101*a* and the body pad 101*b* are located in anatomically necessary sections to provide additional support to the patient's head, torso, knees, and feet. The cranial pad 101*a* and the body pad 101*b* can be made from one piece of the same material.

Figure 2C:
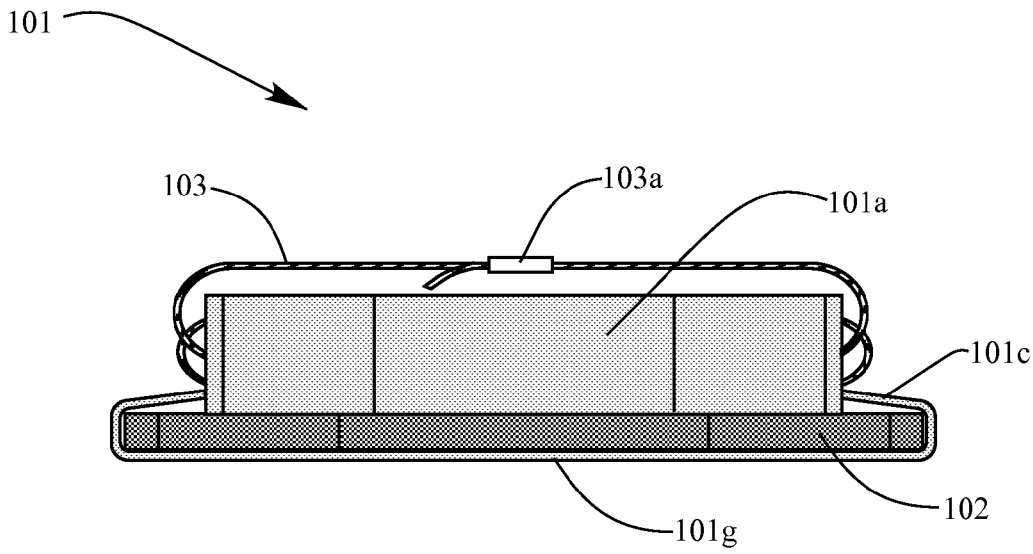
FIG. 2C is a headward end view of the backboard pad assembly shown in FIG. 2A.
Figure 2D:
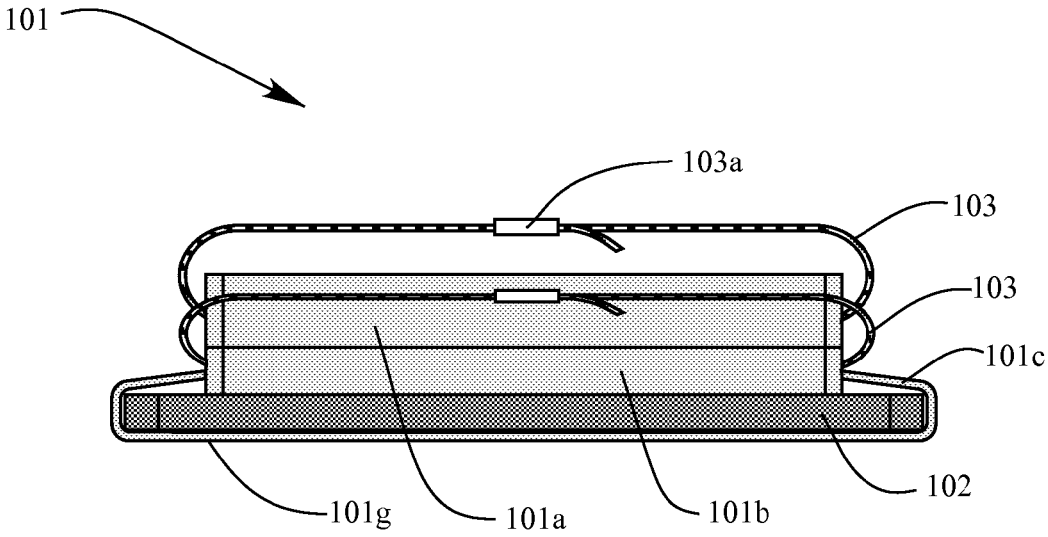
FIG. 2D is a footward end view of the backboard pad assembly shown in FIG. 2A.

FIGS. 2C and 2D have been enlarged to show detail.

FIG. 2C is a headward end view of the backboard pad assembly 101 shown in FIG. 2A. Also shown are restraints 103, restraint buckle 103*a*, cranial pad 101*a*, side wrappings 101*c*, bottom wrapping 101*g*, and backboard 102.

FIG. 2D is a footward end view of the backboard pad assembly 101 shown in FIG. 2A. Also shown are restraints 103, restraint buckle 103*a*, cranial pad 101*a*, body pad 101*b*, side wrappings 101*c*, bottom wrapping 101*g*, and backboard 102.

Figure 2E:
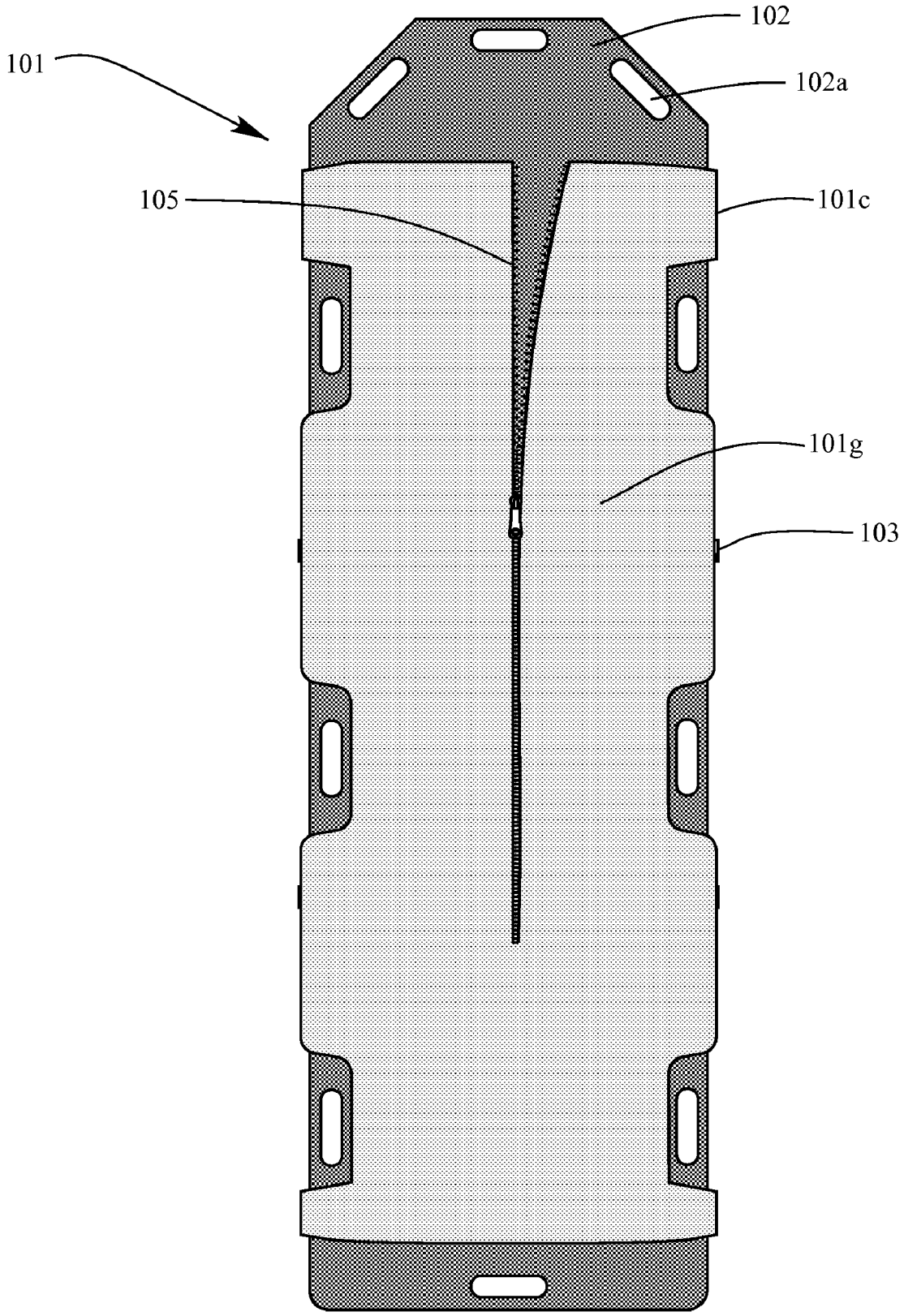
FIG. 2E is a bottom view of one embodiment of the backboard pad assembly shown in FIG. 2A.

FIG. 2E is a bottom view of one embodiment of the backboard pad assembly 101 shown in FIG. 2A. Also shown are backboard 102, zipper 105, backboard handholds 102*a*, bottom wrapping 101*g*, and side wrappings 101*c*. The bottom wrapping 101*g* has an integrated zipper 105, which runs lengthwise down the center of the bottom wrapping 101*g*. The function of the zipper 105 is to relax the side wrappings and facilitate the attachment and removal of the backboard pad assembly 101 to and from the backboard 102. Because the zipper 105 does not run the entire length of the bottom wrapping 101*g*, there is no need for the operator to engage the zipper 105 each time the backboard pad assembly 101 is replaced. In another embodiment, the zipper 105 may extend the entire length of the bottom wrapping 101*g*. In other embodiments, other fastening means may be utilized such as a strip of VELCRO®, snaps, hooks, or the like to perform the zipper's function.

Figure 2F:
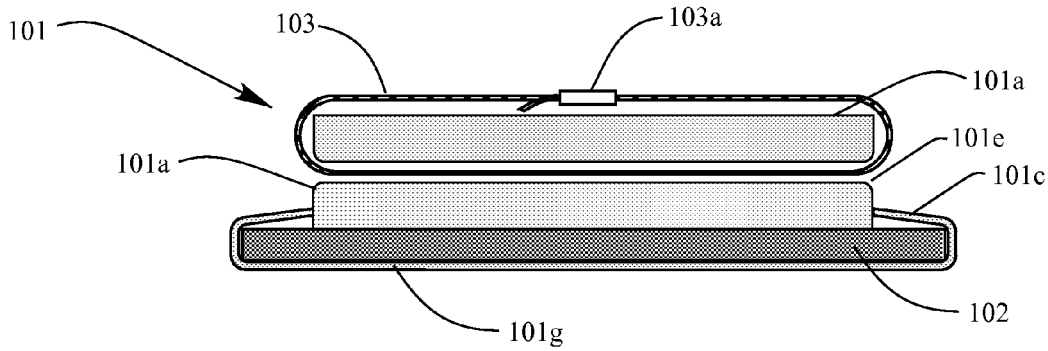
FIG. 2F is a section 2F-2F view of the backboard pad assembly shown in FIG. 2A.
Figure 2G:
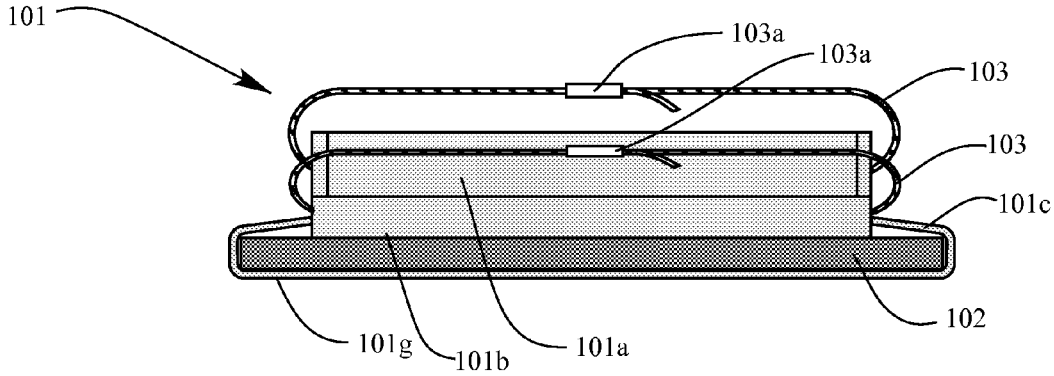
FIG. 2G is a section 2G-2G view of the backboard pad assembly shown in FIG. 2A.
Figure 2H:
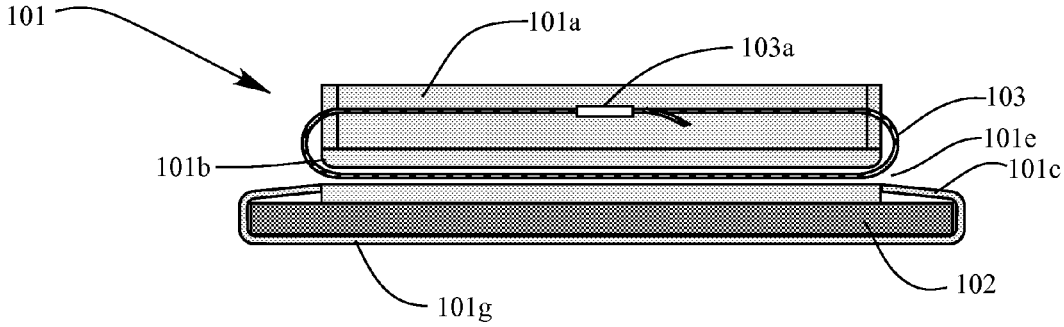
FIG. 2H is a section 2H-2H view of the backboard pad assembly shown in FIG. 2A.

FIGS. 2F, 2G, and 2H have been enlarged to show detail. Slot 101*e* has also been enlarged to show detail.

FIG. 2F is a section 2F-2F view of the backboard pad assembly 101 shown in FIG. 2A. The body restraints are omitted to enhance clarity of the drawings. Shown are cranial restraints 103, cranial restraint buckle 103*a*, cranial pad 101*a* which contains slot 101*e*, bottom wrapping 101*g*, and side wrappings 101*c*. The side wrappings 101*c* and the cranial pad 101*a* may be made of the same material. The slot 101*e* serves as an opening through the cranial pad 101*a* for the placement of the restraints 103.

FIG. 2G is a section 2G-2G view of the backboard pad assembly 101 shown in FIG. 2A. Shown are cranial restraints 103, cranial restraint buckle 103*a*, body restraints 103 and body restraint buckle 103*a*, cranial pad 101*a*, body pad 101*b*, body pad 101*h*, bottom wrapping 101*g*, and side wrappings 101*c*. The side wrappings 101*c*, bottom wrapping 101*g*, and the pads 101*a* and 101*b* may be made of the same material.

FIG. 2H is a section 2H-2H view of the backboard pad assembly 101 shown in FIG. 2A. The cranial restraints are omitted to enhance clarity of the drawings. Shown are body restraints 103, body restraint buckle 103*a*, cranial pad 101*a*, body pad 101*b*, bottom wrapping 101*g*, and side wrappings 101*c*. The side wrappings 101*c* and bottom wrapping 101*g* may be made of the same material. The slot 101*e* serves as an opening through the body pad 101*b* for the placement of a restraint 103.

FIGS. 3A, 3B, 3C, 3D, and 3E are the same as FIGS. 2A, 2B, 2C, 2D, and 2E.

Figure 3A:
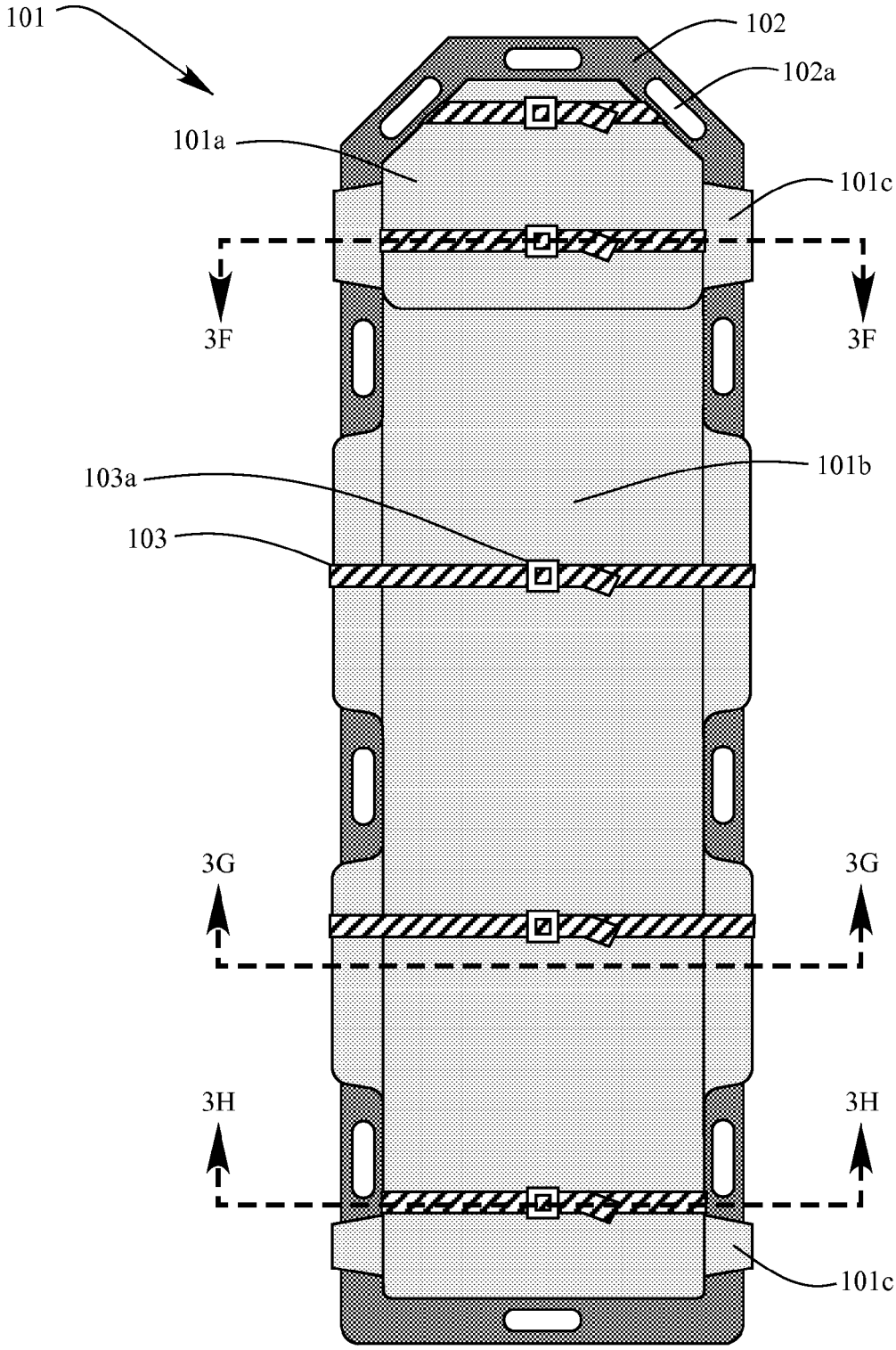
FIG. 3A is a top view of another embodiment of the backboard pad assembly.
Figure 3B:
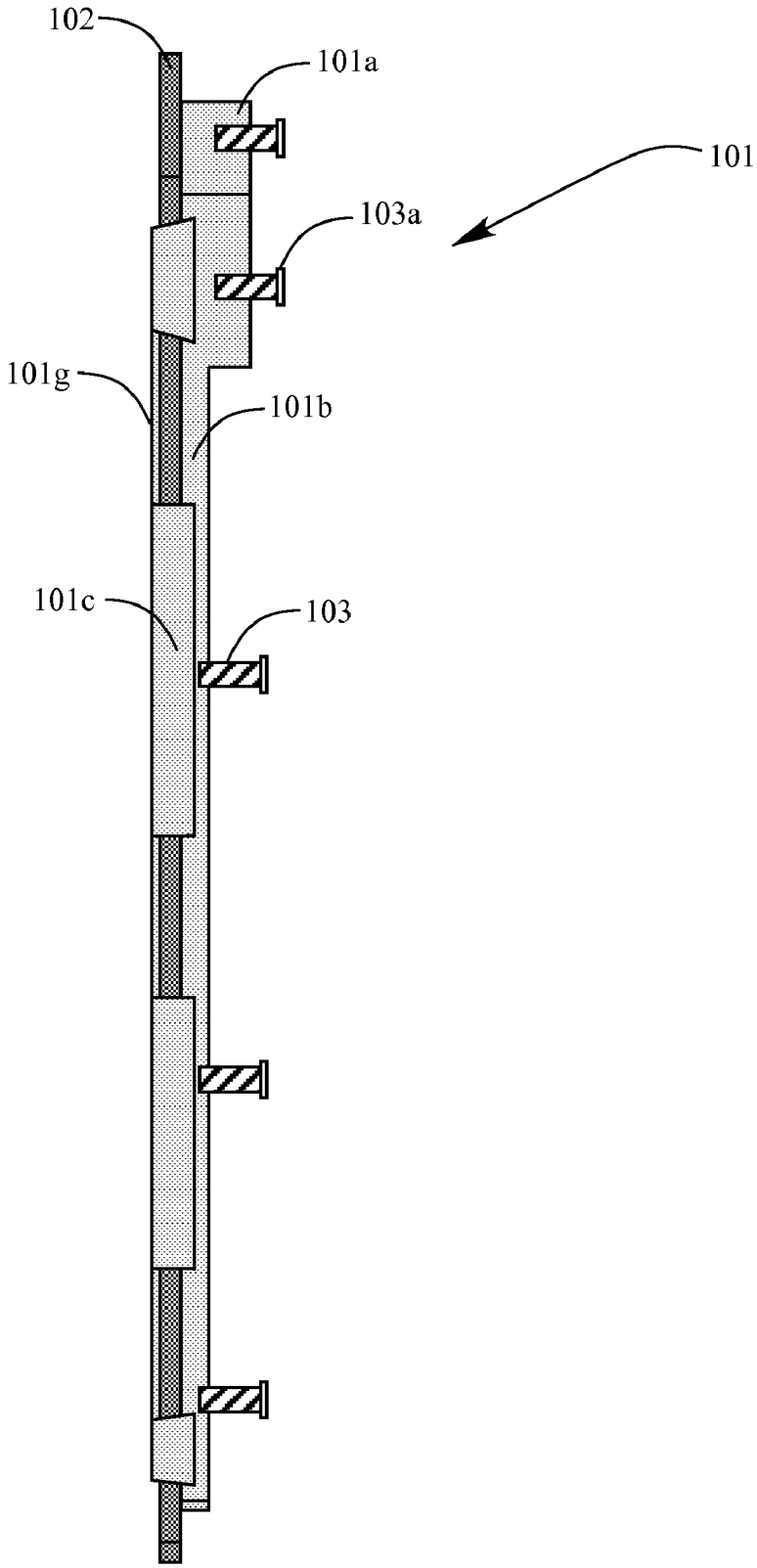
FIG. 3B is a left side view of the backboard pad assembly shown in FIG. 3A. The right side view is a mirror image of FIG. 3B.
Figure 3C:
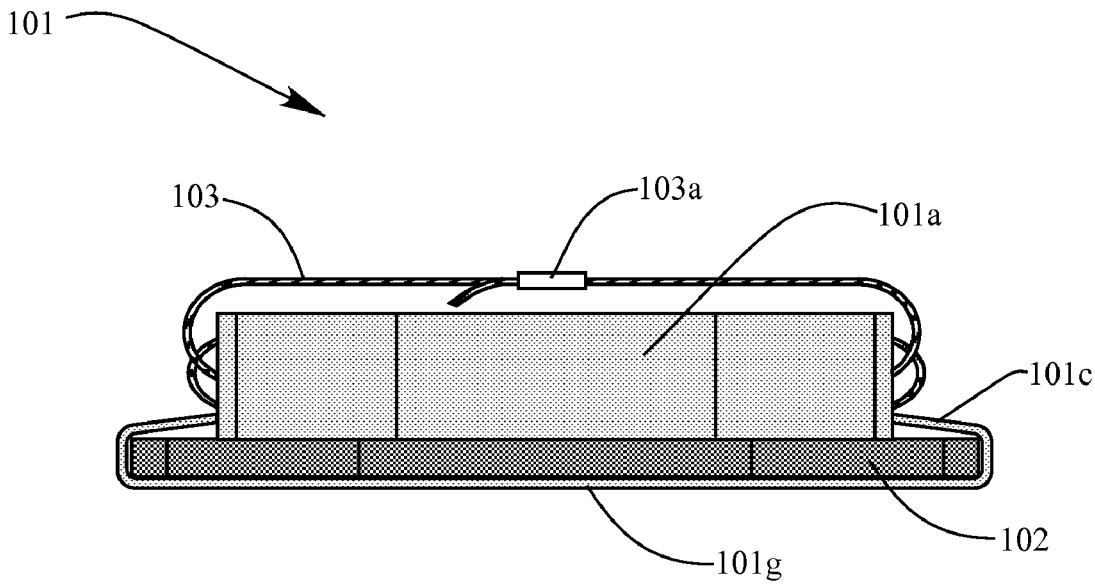
FIG. 3C is a headward end view of the backboard pad assembly shown in FIG. 3A.
Figure 3D:
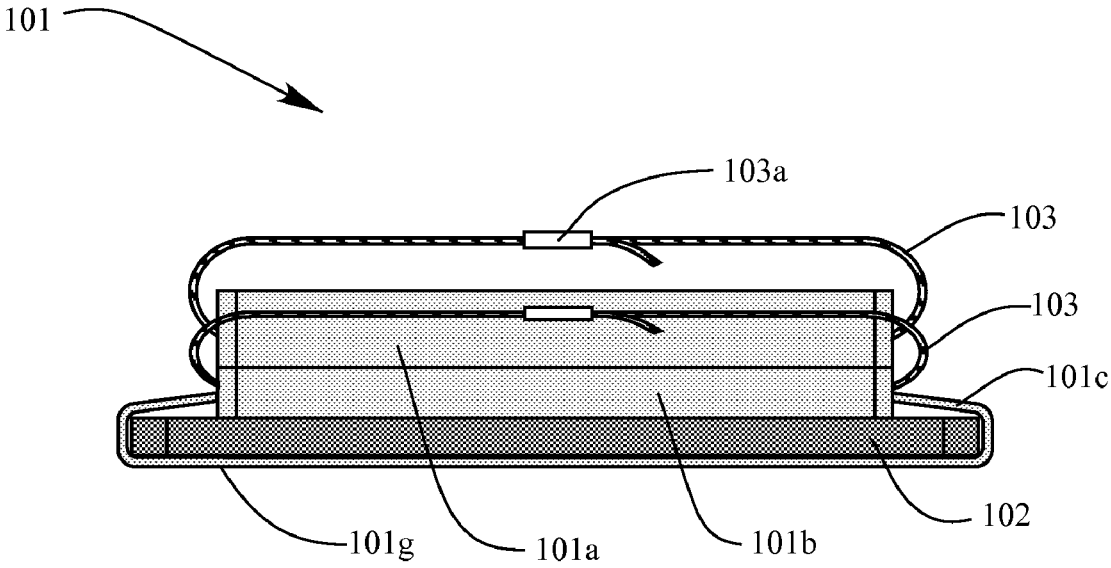
FIG. 3D is a footward end view of the backboard pad assembly shown in FIG. 3A.
Figure 3E:
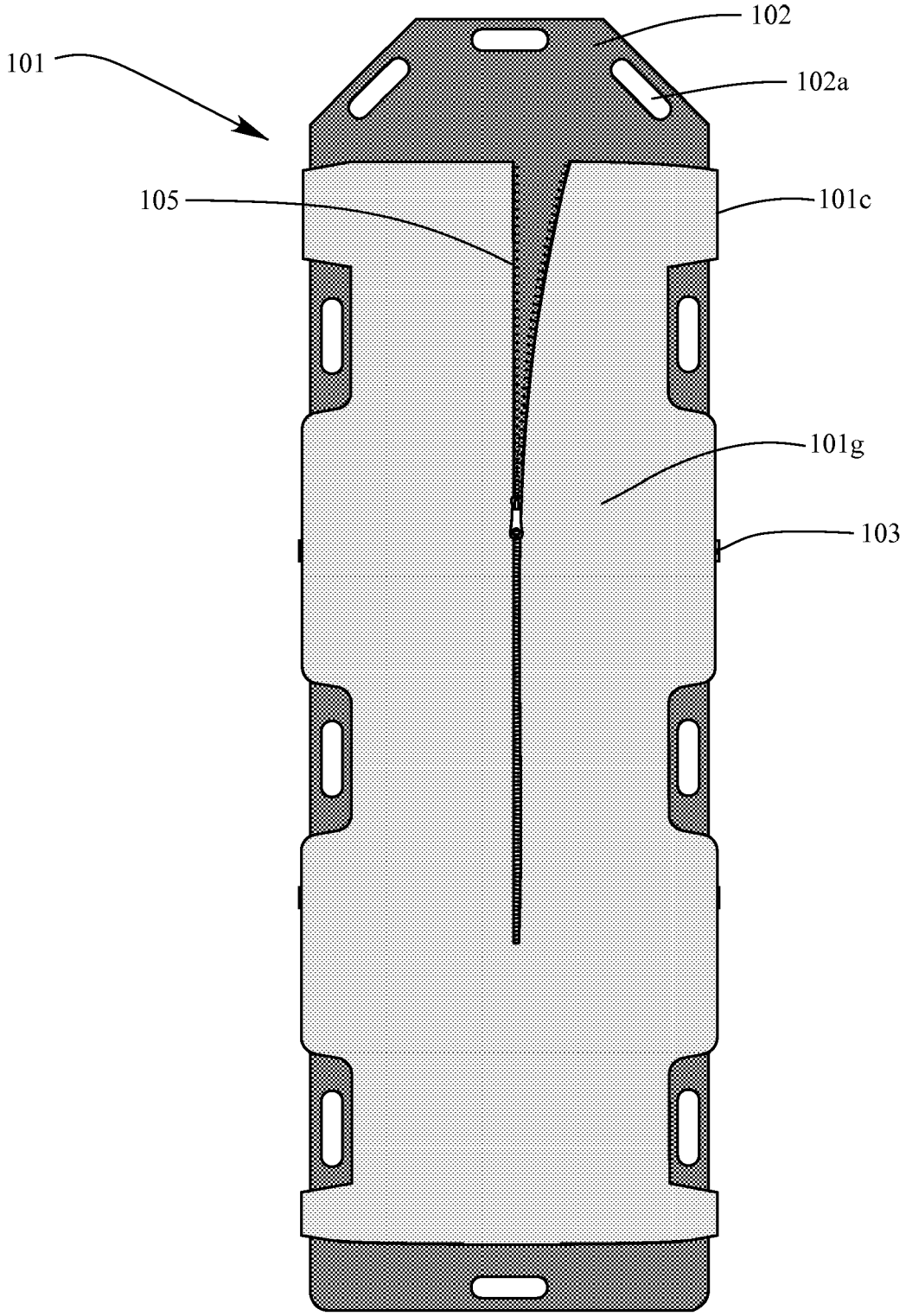
FIG. 3E is a bottom view of one embodiment of the backboard pad assembly shown in FIG. 3A.
Figure 3F:
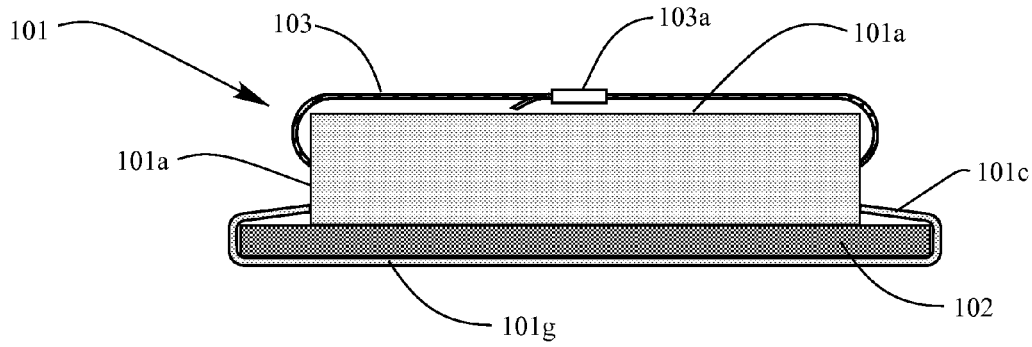
FIG. 3F is a section 3F-3F view of the backboard pad assembly shown in FIG. 3A.
Figure 3G:
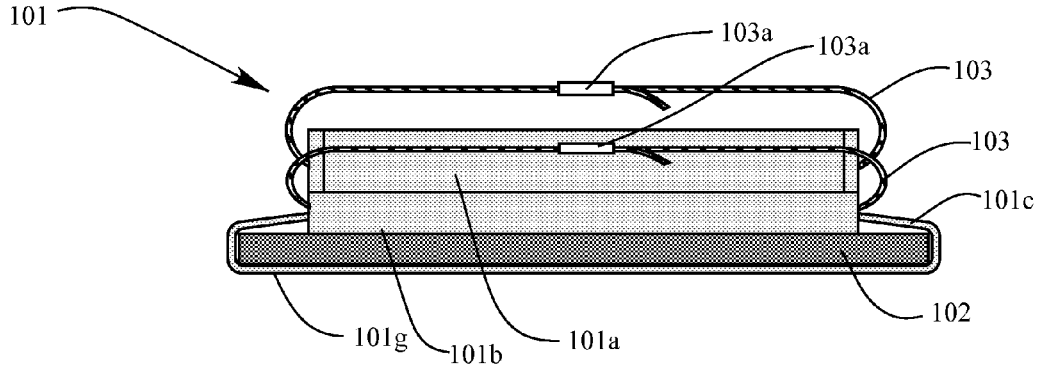
FIG. 3G is a section 3G-3G view of the backboard pad assembly shown in FIG. 3A.
Figure 3H:
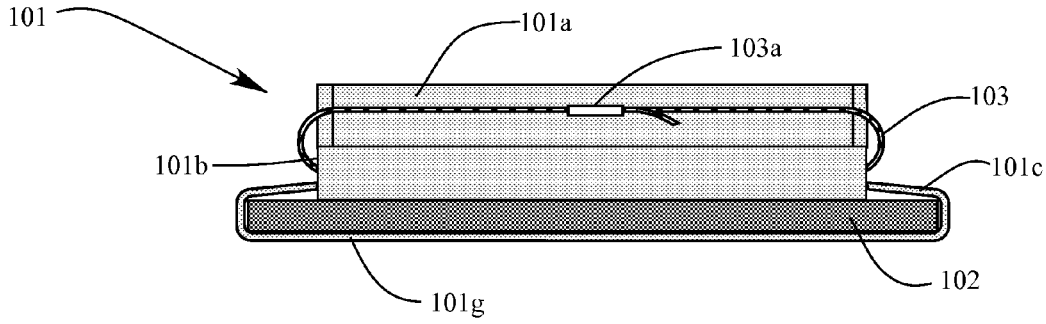
FIG. 3H is a section 3H-3H view of the backboard pad assembly shown in FIG. 3A.

FIGS. 3F, 3G, and 3H have been enlarged to show detail of another embodiment.

FIG. 3F is a section 3F-3F view of the backboard pad assembly 101 shown in FIG. 3A. The body restraints are omitted to enhance clarity of the illustration. Shown are cranial restraints 103, cranial restraint buckle 103*a*, cranial pad 101*a*, and bottom wrapping 101*g*, and side wrappings 101*c*. The restraints 103 are securely attached to the cranial pad 101*a*.

FIG. 3G is a section 3G-3G view of the backboard pad assembly 101 shown in FIG. 3A. Shown are cranial restraints 103, cranial restraint buckle 103*a*, body restraints 103 and body restraint buckle 103*a*, cranial pad 101*a*, body pad 101*b*, bottom wrapping 101*g*, and side wrappings 101*c*.

FIG. 3H is a section 3H-3H view of the backboard pad assembly 101 shown in FIG. 3A. The cranial restraints are omitted to enhance clarity of the illustration. Shown are body restraints 103, body restraint buckle 103*a*, cranial pad 101*a*, body pad 101*b*, bottom wrapping 101*g*, and side wrappings 101*c*. The side wrappings 101*c* and the bottom wrapping 101*g* may be made from one continuous piece or separate pieces of elastic material or the like. The restraints 103 are securely attached to the body pad 101*b*.

Figure 4A:
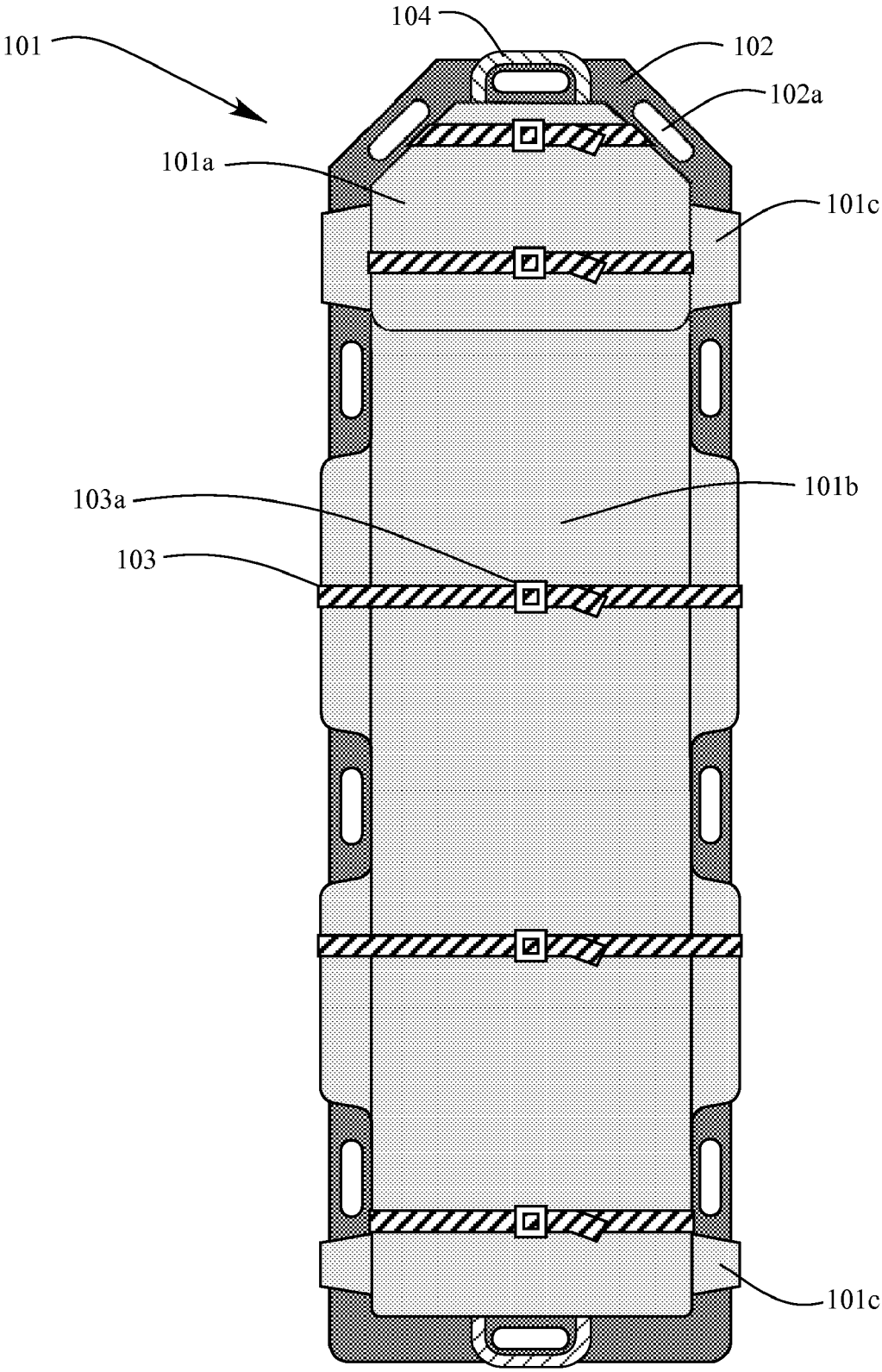
FIG. 4A is a top view of another embodiment of the backboard pad assembly.

FIG. 4A is a top view of another embodiment of the backboard pad assembly 101. Also shown are end straps 104, backboard 102, backboard handholds 102*a*, cranial pad 101*a*, body pad 101*b*, restraints 103, restraint buckle 103*a*, and side wrappings 101*c*. The end straps 104 maintain the backboard pad assembly 101 in a proper position on the backboard 102.

Figure 4B:
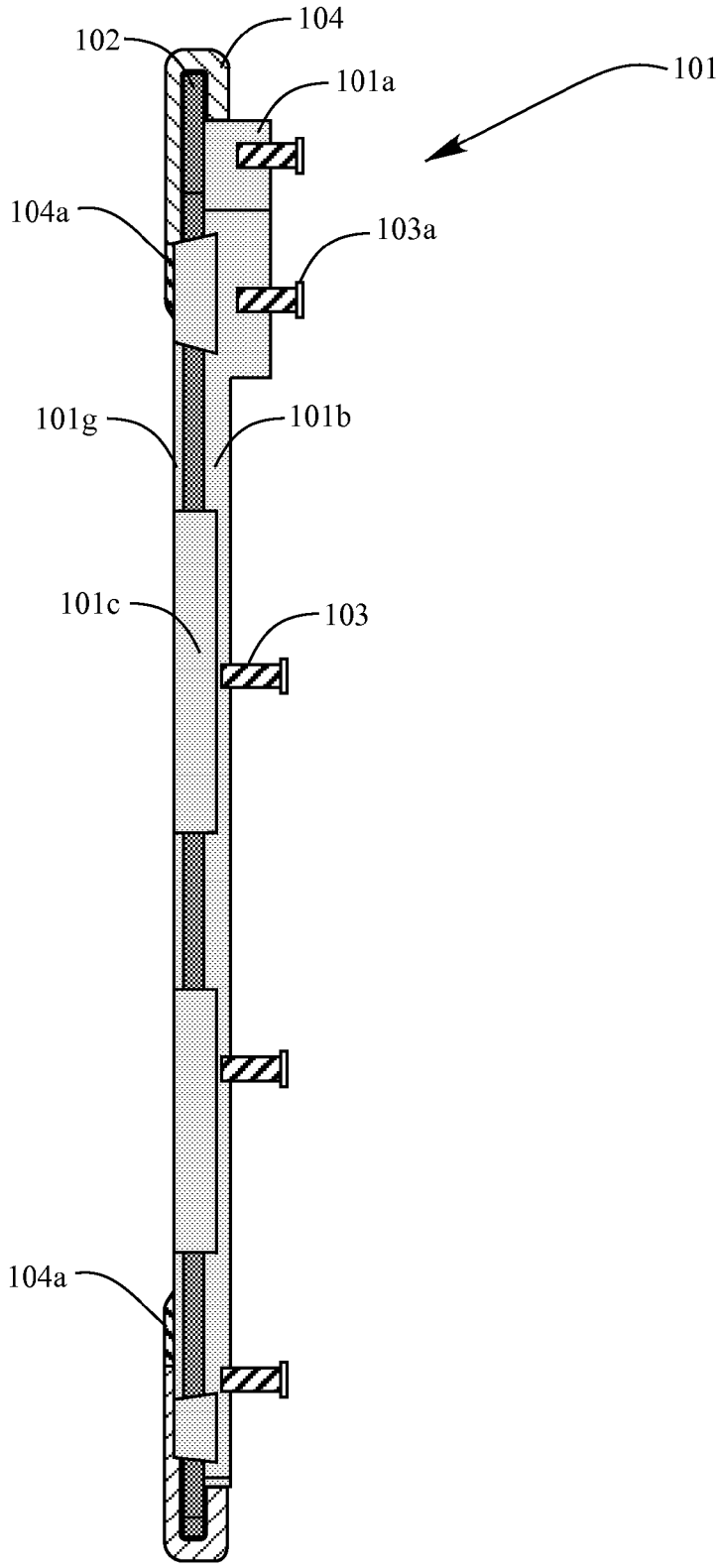
FIG. 4B is a left side view of the backboard pad assembly shown in FIG. 4A, The right side view is a mirror image of FIG. 4B.

FIG. 4B is a left side view of the backboard pad assembly 101 shown in FIG. 4A. The right side view is a mirror image of FIG. 4B. Also shown are end straps 104, end strap attachments 104*a*, backboard 102, cranial pad 101*a*, body pad 101*b*, restraints 103, restraint buckle 103*a*, and side wrappings 101*c*. The pads 101*a* and 101*b* are located in anatomically necessary sections to provide additional support for the patient's head, torso, knees, and feet. The attachment 104*a* may be any suitable material such as VELCRO®.

Figure 4C:
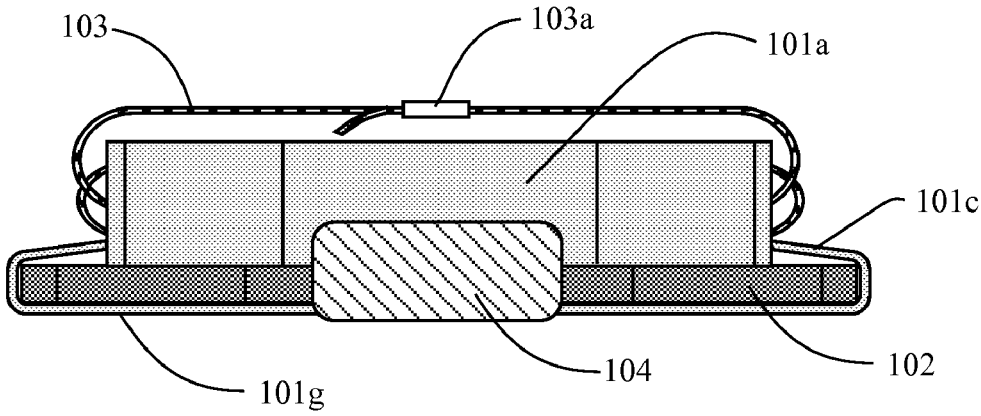
FIG. 4C is a headward end view of the backboard pad assembly shown in FIG. 4A.
Figure 4D:
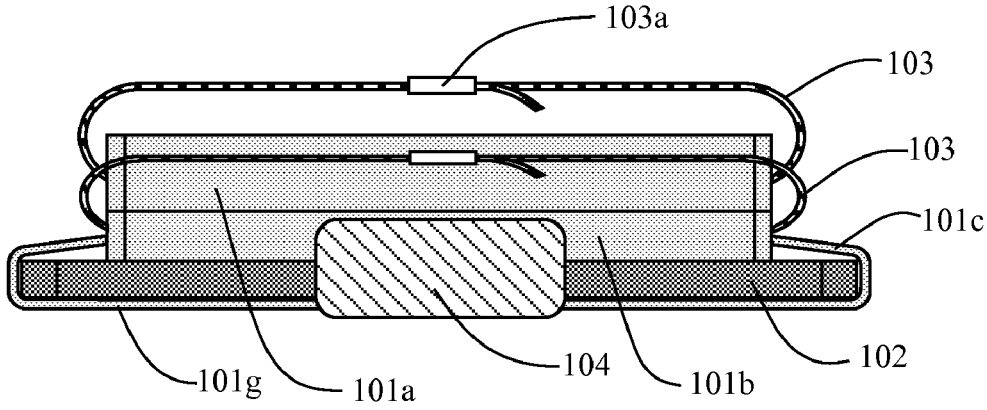
FIG. 4D is a footward end view of the backboard pad assembly shown in FIG. 4A.

FIGS. 4C and 4D have been enlarged to show detail.

FIG. 4C is a headward end view of the backboard pad assembly 101 shown in FIG. 4A. Also shown are end strap 104, restraints 103, restraint buckle 103*a*, cranial pad 101*a*, side wrappings 101*c*, and backboard 102.

FIG. 4D is a footward end view of the backboard pad assembly 101 shown in FIG. 4A. Also shown are end strap 104, restraints 103, restraint buckles 103*a*, cranial pad 101*a*, body pad 101*b*, side wrappings 101*c*, and backboard 102.

Figure 4E:
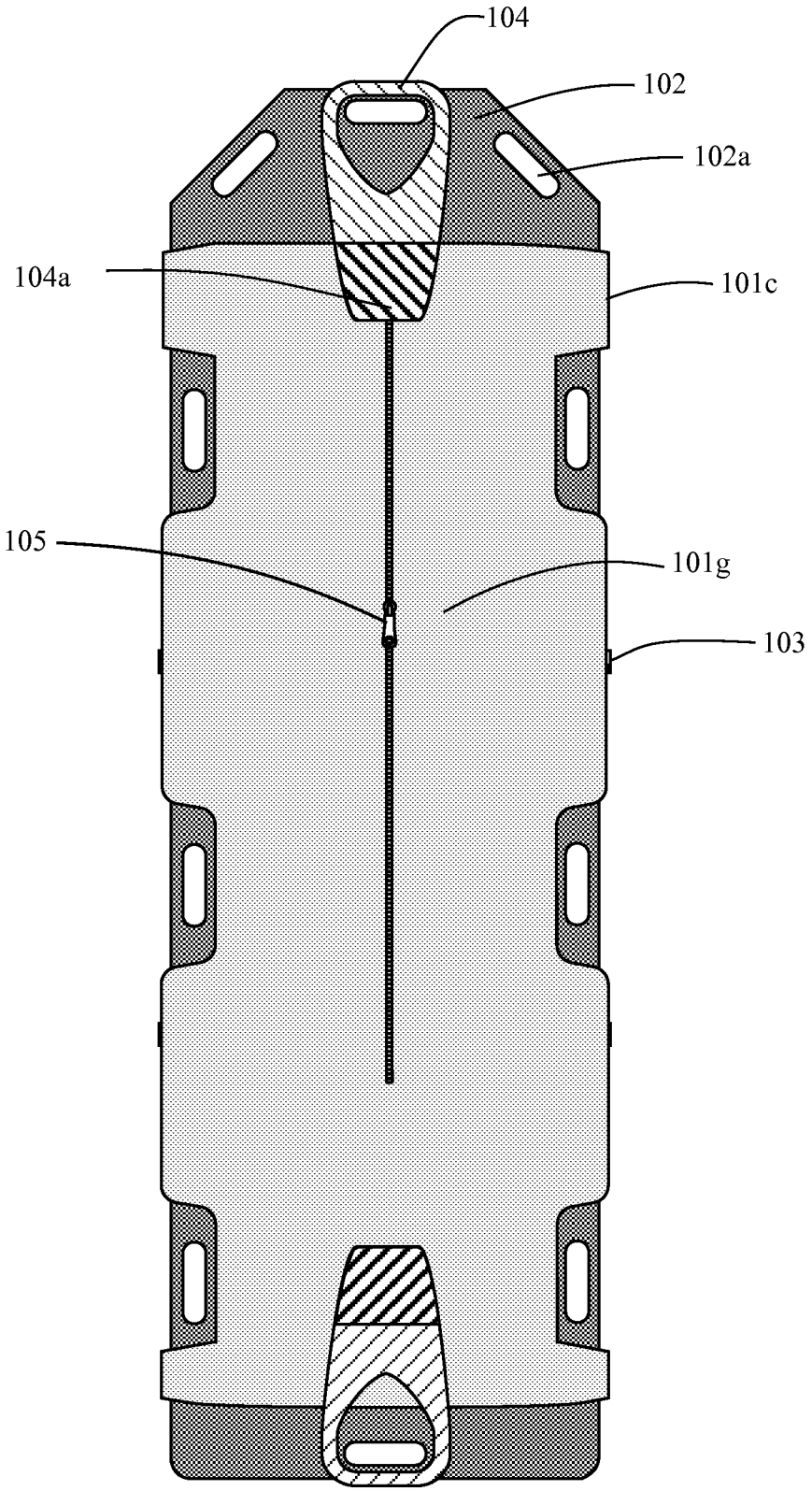
FIG. 4E is a bottom view of one embodiment of the backboard pad assembly shown in FIG. 4A.

FIG. 4E is a bottom view of one embodiment of the backboard pad assembly 101 shown in FIG. 4A. Also shown are end straps 104, end strap VELCRO® attachments 104*a*, backboard 102, backboard handholds 102*a*, zipper 105, and side wrappings 101*c*.

Figure 4F:
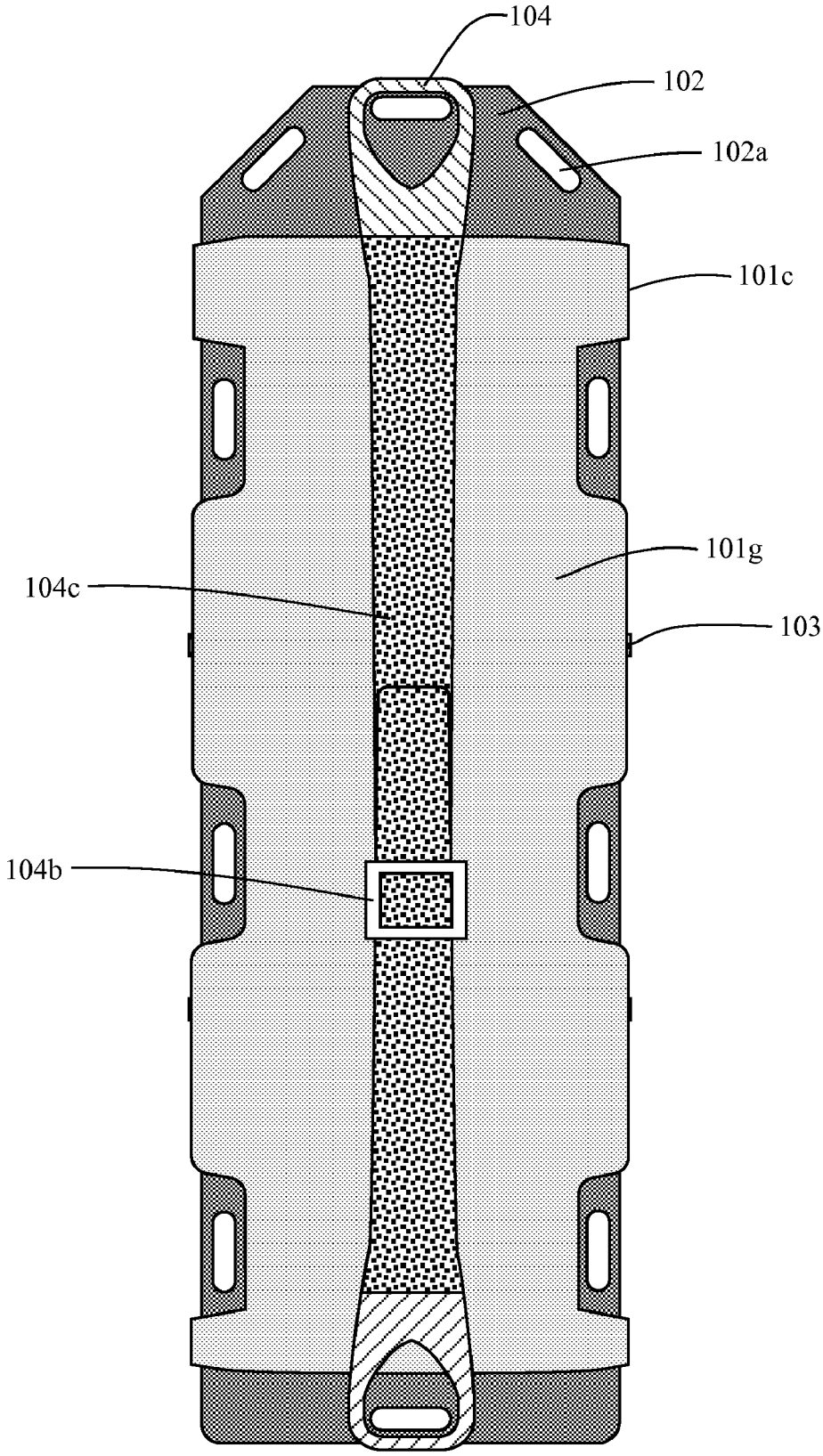
FIG. 4F is a bottom view of another embodiment of the backboard pad assembly shown in FIG. 4A.

FIG. 4F is a bottom view of another embodiment of the backboard pad assembly 100 shown in FIG. 4A. Also shown are end straps 104, end strap attachment extensions 104*c*, end strap buckle 104*b*, backboard 102, backboard handholds 102*a*, and side wrappings 101*c*. The zipper 105 is not visible in this view, but is located under the end strap attachment extensions 104*c*.

Figure 5A:
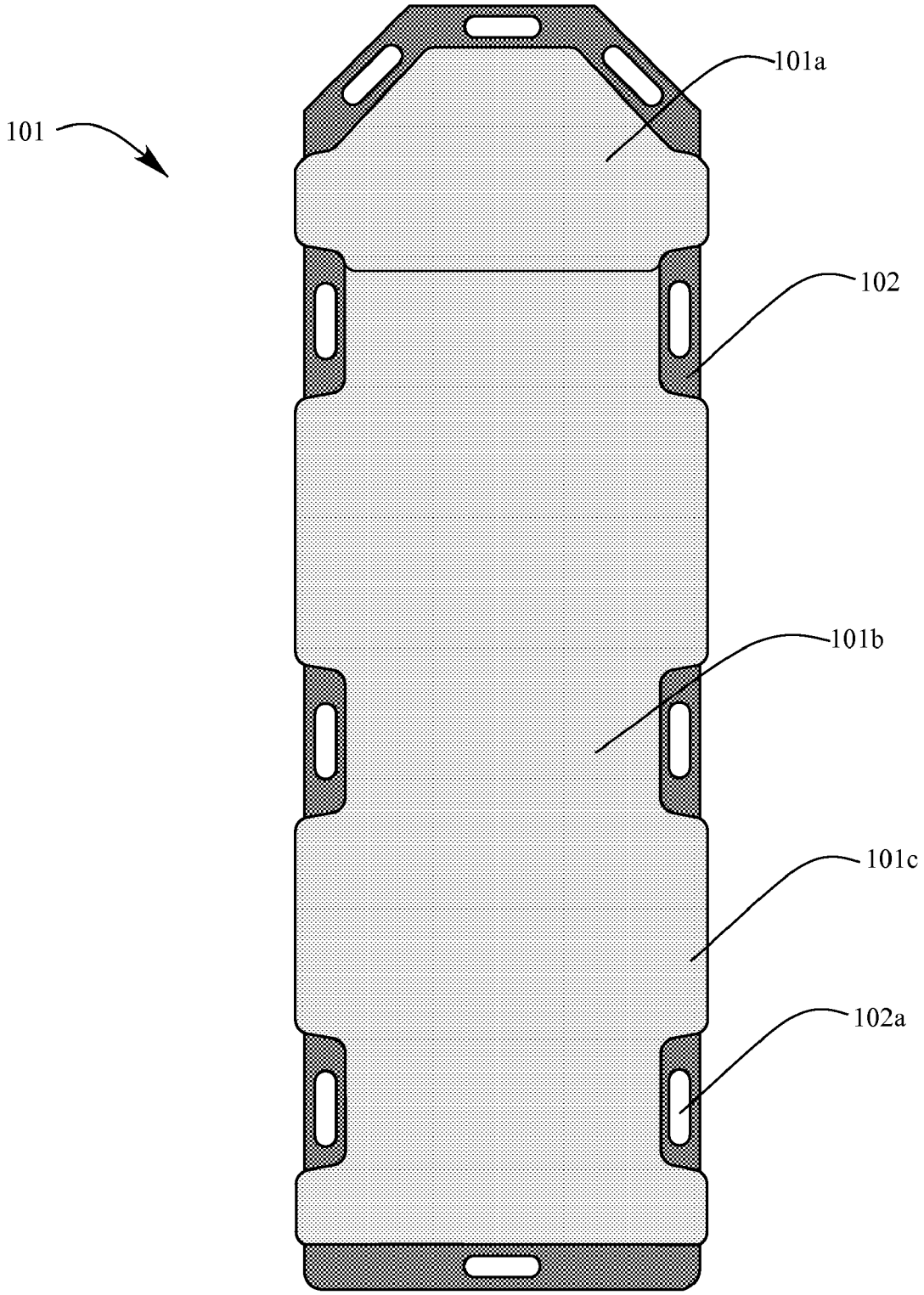
FIG. 5A is a top view of the backboard pad assembly.

FIG. 5A is a top view of another embodiment of the backboard pad assembly 101. FIG. 5A alternately demonstrates the cranial pad 101*a* extending to the edges of the body pad 101*b*. Here the body pad 101*b* has recesses to allow for clearance of the backboard handholds 102*a*. The side wrappings 101*c* extend around the backboard 102. Tension from the elastic nature of the side wrappings 101*c* keeps the backboard pad assembly 101 securely attached to the backboard 102.

The edges of the cranial pad 101*a* and body pad 101*b* extend to the edges of the backboard 102, but the edges of the pad are recessed to the inner limits of the handholds 102*a* present on the backboard 102 as shown in FIG. 5A.

Figure 5B:
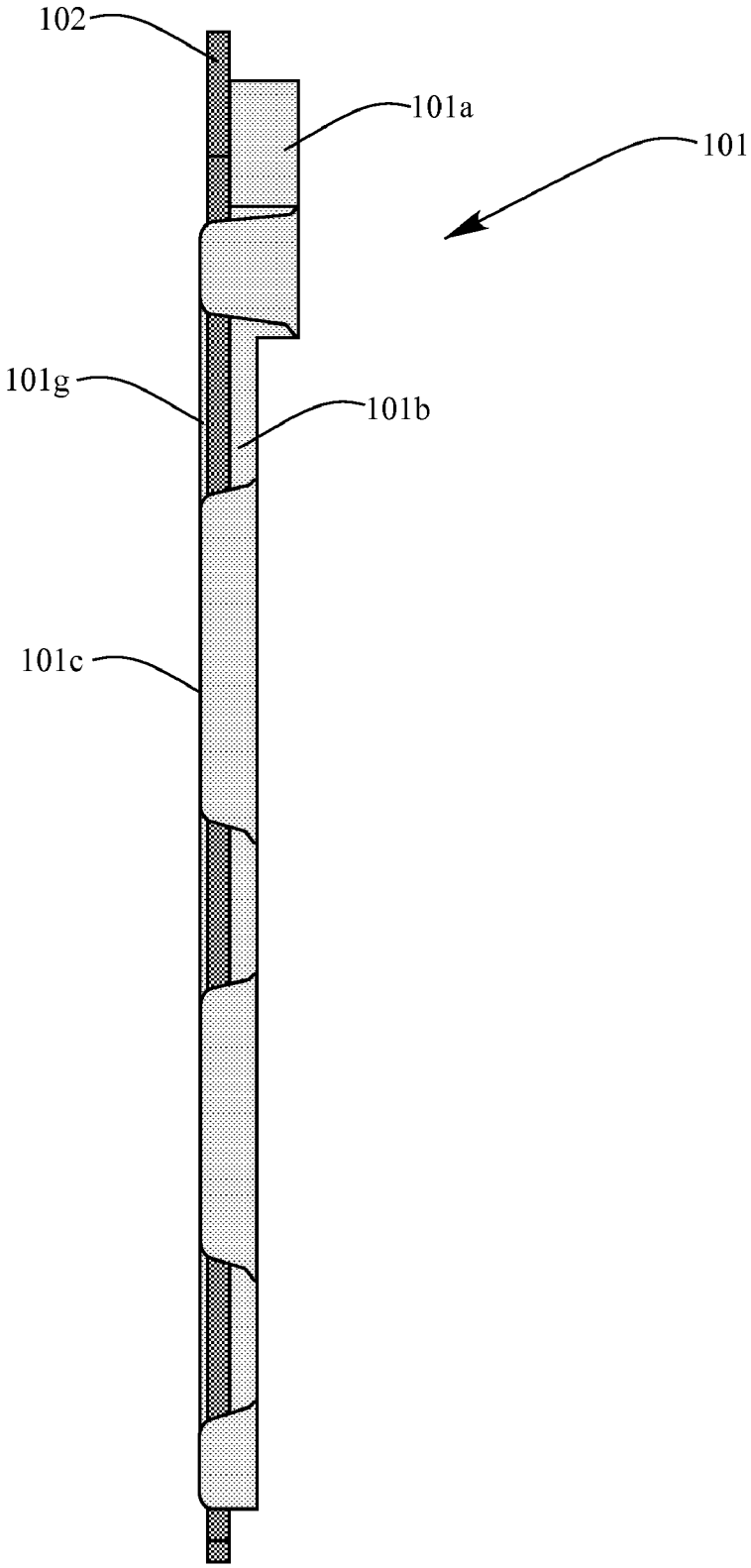
FIG. 5B is a left side view of the backboard pad assembly. The right side view is a mirror image of FIG. 5B.

FIG. 5B is a left side view of the backboard pad assembly 101 shown in FIG. 5A. The right side view is a mirror image of FIG. 5B. Also shown are backboard 102, cranial pad 101*a*, body pad 101*b*, side wrappings 101*c*, and bottom wrapping 101*g*. The cranial pad 101*a* and the body pad 101*b* are located in anatomically necessary sections to provide additional support to the patient's head, torso, knees, and feet. The cranial pad 101*a* and the body pad 101*b* can be made from one piece of the same material.

Figure 5C:
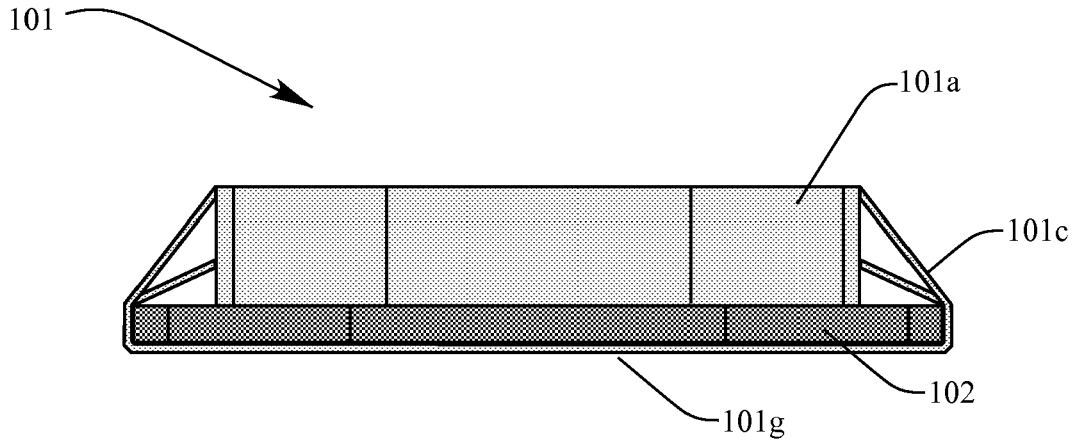
FIG. 5C is a headward end view of the backboard pad assembly.
Figure 5D:
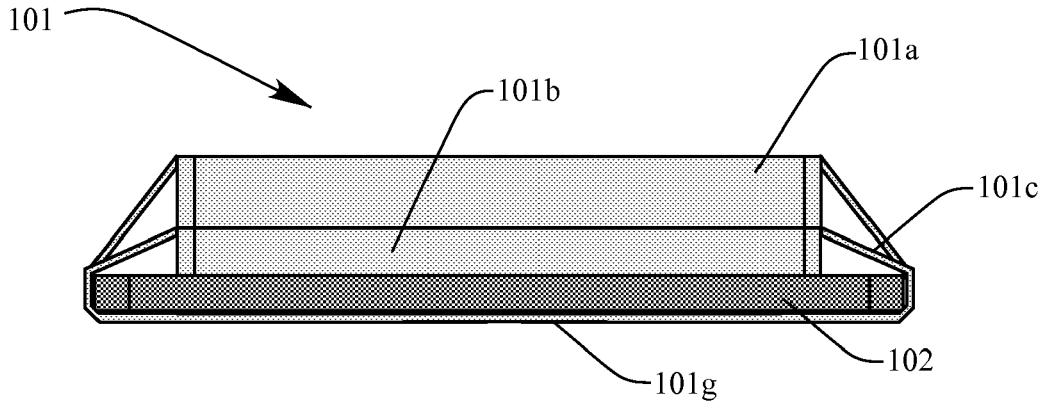
FIG. 5D is a footward end view of the backboard pad assembly.

FIGS. 5C and 5D have been enlarged to show detail.

FIG. 5C is a headward end view of the backboard pad assembly 101 shown in FIG. 5A. Also shown are cranial pad 101*a*, side wrappings 101*c*, bottom wrapping 101*g*, and backboard 102.

The side wrappings 101*c* extend from the top of the pads 101*a* and 101*b*.

FIG. 5D is a footward end view of the backboard pad assembly 101 shown in FIG. 5A. Also shown are cranial pad 101*a*, body pad 101*b*, side wrappings 101*c*, bottom wrapping 101*g*, and backboard 102. The side wrappings 101*c* extend from the top of the pads 101*a* and 101*b*.

Figure 5E:
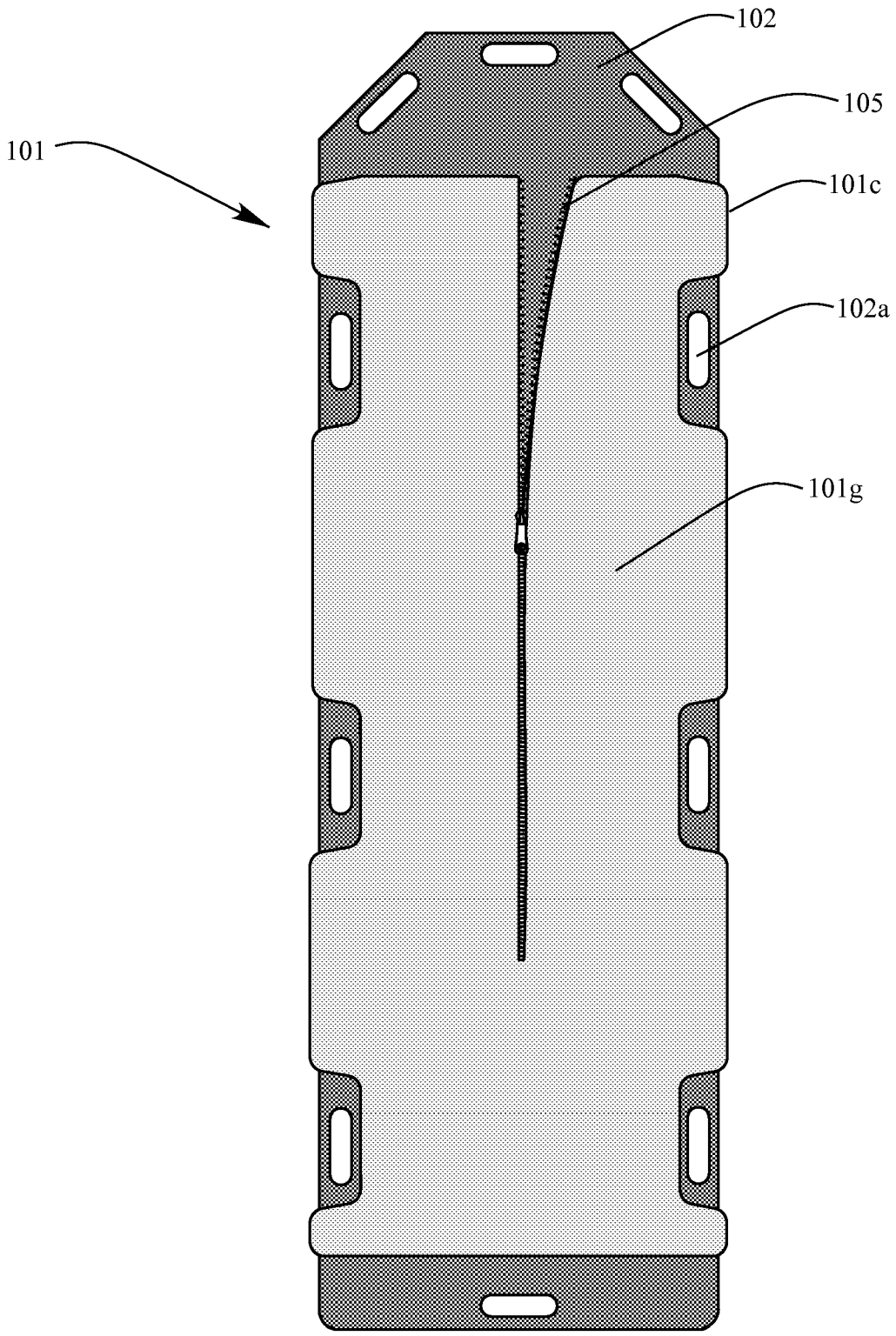
FIG. 5E is a bottom view of one embodiment of the backboard pad assembly.

FIG. 5E is a bottom view of one embodiment of the backboard pad assembly 101 shown in FIG. 5A. Also shown are backboard 102, zipper 105, backboard handholds 102*a*, bottom wrapping 101*g*, and side wrappings 101*c*. The bottom wrapping 101*g* has an integrated zipper 105, which runs lengthwise down the center of the bottom wrapping 101*g*. The function of the zipper 105 is to relax the side wrappings and facilitate the attachment and removal of the backboard pad assembly 101 to and from the backboard 102. Because the zipper 105 does not run the entire length of the bottom wrapping 101*g*, there is no need for the operator to engage the zipper 105 each time the backboard pad assembly 101 is replaced. In another embodiment, the zipper 105 may extend the entire length of the bottom wrapping 101*g*. In other embodiments, other fastening means may be utilized such as a strip of VELCRO®, snaps, hooks, or the like to perform the zipper's function.

The above description discloses a preferred embodiment. However, those of ordinary skill in the art to which the invention pertains will be aware of variations and modifications that do not from the scope of Applicant's invention as hereinafter claimed.

The invention claimed is:

1. A backboard pad assembly comprising a body pad adapted to support substantially the whole body of a user with side wrappings and a back coverslip attached to the body pad, said body pad having a width that is less than the distance between side handholds of an associated backboard such that the backboard handholds are not covered by the body pad, the body pad having a length such that any end handholds of the associated backboard are not covered by the body pad, said side wrappings having spaced apart openings to allow for clearance of handholds along the sides of the associated backboard.

2. The invention of claim 1 wherein there is a cranial pad on the body pad where the patient's head is located.

3. The invention of claim 2 wherein said body pad and cranial pad are made of a foam material.

4. The invention of claim 3 wherein the body pad foam and cranial pad foam are made from or coated with a waterproof and chemically resistant material that can be medically disinfected.

5. The invention of claim 2 wherein the body pad and cranial pad are one piece.

6. The invention of claim 2 wherein the body pad and cranial pad are two separate pieces attached together.

7. The invention of claim 1 wherein the side wrappings and back coverslip are attached to the sides of the body pad, the back coverslip extending around the associated backboard so as to retain the body pad to the backboard.

8. A backboard and pad assembly comprising a body pad adapted to support substantially the whole body of a user with attached side wrappings and a back coverslip that extend around the associated backboard so as to attach the body pad to the backboard, said body pad being made of a foam material having a waterproof and chemically resistant coating that can be medically disinfected, said side wrappings having spaced apart openings to allow for clearance of handholds along the sides of the associated backboard.

9. The invention of claim 8 wherein there is a cranial pad on the body pad in the area of the body pad where the patient's head is located.

10. The invention of claim 8 wherein the body pad and cranial pad are one piece.

11. The invention of claim 8 wherein the body pad and cranial pad are two separate pieces connected together.

12. A backboard pad assembly comprising a body pad adapted to support substantially the whole body of a user and attached side wrappings and a back coverslip, said body pad having a width and length equal to the width and length of an associated backboard, said body pad having recesses for clearance of handholds in the backboard, said body pad conforming to the profile of the backboard when viewed from above, said side wrappings and back coverslip extending around the associated backboard to retain the body pad to the backboard, said side wrappings having spaced apart openings to allow for clearance of handholds along the sides of the associated backboard.

13. The invention of claim 12 wherein there is a cranial pad in the body pad area where the patient's head is located.

14. The invention of claim 13 wherein the body pad and the cranial pad are covered with a coating that is waterproof and chemically resistant and capable of being medically disinfected.

15. The invention of claim 13 wherein the body pad and cranial pad are made of a foam material covered with a coating that is waterproof and chemically resistant and capable of being medically disinfected.

16. The invention of claim 12 wherein the body pad and cranial pad are one piece.

17. The invention of claim 12 wherein the body pad and cranial pad are two separate pieces connected together.

18. The invention of claim 12 wherein the body pad is made from or covered with a coating that is waterproof and chemically resistant and capable of being medically disinfected.

19. The invention of claim 12 wherein the body pad is made of a foam material, the foam pad being covered with a coating that is waterproof and chemically resistant and capable of being medically disinfected.

* * * * *